US005827618A

United States Patent [19]

Oyagi et al.

[11] Patent Number: 5,827,618

[45] Date of Patent: Oct. 27, 1998

[54] RUST-PROOFING STEEL SHEET FOR FUEL TANKS AND PRODUCTION METHOD THEREOF

[75] Inventors: Yashichi Oyagi; Takayuki Omori; Masahiro Fuda; Ken Sawada; Nobuyoshi Okada, all of Kitakyushu, Japan

[73] Assignee: Nippon Steel Corporation, Tokyo, Japan

[21] Appl. No.: 750,073

[22] PCT Filed: Mar. 28, 1996

[86] PCT No.: PCT/JP96/00835

§ 371 Date: Nov. 27, 1996

§ 102(e) Date: Nov. 27, 1996

[87] PCT Pub. No.: WO96/30560

PCT Pub. Date: Oct. 3, 1996

[30] Foreign Application Priority Data

| | | | |
|---|---|---|---|
| Mar. 28, 1995 | [JP] | Japan | 7-069087 |
| Mar. 29, 1995 | [JP] | Japan | 7-070259 |
| Mar. 29, 1995 | [JP] | Japan | 7-070260 |
| Mar. 30, 1995 | [JP] | Japan | 7-073140 |
| May 31, 1995 | [JP] | Japan | 7-132995 |
| Jun. 20, 1995 | [JP] | Japan | 7-152846 |
| Sep. 1, 1995 | [JP] | Japan | 7-224906 |
| Sep. 6, 1995 | [JP] | Japan | 7-228709 |

[51] Int. Cl.[6] ..... B21D 39/00; B32B 15/01; B05D 1/36; C21D 1/09

[52] U.S. Cl. ..... 428/621; 428/624; 428/646; 428/648; 428/658; 428/659; 428/680; 428/681; 428/682; 428/684; 427/398.1; 427/405; 427/433; 148/530

[58] Field of Search ..... 428/646, 648, 428/658, 659, 680, 681, 682, 684, 621, 624; 427/398.01, 405, 433; 148/530

[56] References Cited

U.S. PATENT DOCUMENTS

| | | | |
|---|---|---|---|
| 2,703,766 | 3/1955 | Ellis et al. | 117/114 |
| 3,857,684 | 12/1974 | Kubu | 29/196.5 |
| 4,151,015 | 4/1979 | Cooper | 148/23 |
| 4,461,679 | 7/1984 | Higuchi et al. | 204/27 |
| 4,849,301 | 7/1989 | Kanasashi | 428/623 |
| 5,422,192 | 6/1995 | Takahashi et al. | 428/632 |
| 5,455,122 | 10/1995 | Carey et al. | 428/659 |

FOREIGN PATENT DOCUMENTS

| | | |
|---|---|---|
| 61-270391 | 11/1986 | Japan . |
| 62-230987 | 10/1987 | Japan . |
| 1-177387 | 7/1989 | Japan . |
| 4-214848 | 8/1992 | Japan . |
| 5-106058 | 4/1993 | Japan . |
| 6-88183 | 3/1994 | Japan . |
| 6-173086 | 6/1994 | Japan . |
| 6-306637 | 11/1994 | Japan . |

*Primary Examiner*—Paul J. Thibodeau
*Assistant Examiner*—Holly C. Rickman
*Attorney, Agent, or Firm*—Kenyon & Kenyon

[57] ABSTRACT

This invention provides a rust-proofed steel sheet for a fuel tank including an alloy layer containing at least one of Ni, Fe, Zn and Sn and deposited on the surface of a steel sheet to a thickness of 2 $\mu$m per surface, and a Sn—Zn alloy plating layer consisting of 40 to 99 wt % of Sn and the balance of iron, containing not greater than 20 crystals/0.25 $mm^2$ of zinc crystals having a major diameter of not greater than 250 $\mu$m and deposited on the alloy layer to a thickness of 2 to 50 $\mu$m per surface. The to-be-plated steel sheet to which the plating layer is applied has a composition consisting of C≦0.1%, Si≦0.1%, Mn: 0.05 to 1.2%, P≦0.040%, Al<0.1% and if necessary, at least one of B, Ti, Nb and Cr, and the balance of Fe and unavoidable impurities. This invention provides also a production method of a rust-proofing steel sheet for a fuel tank comprising the steps of applying Ni—Fe type pre-plating to an annealed steel sheet in a quantity of 0.1 to 3.0 $g/m^2$ per surface in terms of a Ni content, applying flux containing hydrochloric acid in a quantity of 2 to 45 wt % in terms of chlorine, immersing the steel sheet in a bath consisting of 40 to 99 wt % of Sn and the balance of Zn for less than 15 seconds at a bath temperature of (melting point+20° C.) to (melting point+300° C.) of a plating bath metal, for plating.

19 Claims, 2 Drawing Sheets

RUST-PROOFING STEEL SHEET FOR FUEL TANKS AND PRODUCTION METHOD THEREOF

TECHNICAL FIELD

This invention relates to a rust-proofing steel sheet mainly used for fuel tanks of automobiles or for wiring members of electric (and electronic) appliances, and a production method thereof.

BACKGROUND ART

A lead-tin alloy plated steel sheets having excellent corrosion resistance, press formability, solderability (weldability), etc., have been mainly used as a material for fuel tanks in the past, and have found a widespread applications as fuel tanks for automobiles. A Zn—Sn alloy plated steel sheet is excellent in corrosion resistance and solderability (weldability) because it contains tin besides zinc, and has been used for wiring members of electric (and electronic) appliances. This Zn—Sn alloy plated steel sheet has been produced mainly by an electroplating method which conducts electrolysis in an aqueous solution containing Zn—Sn ions when Zn—Sn alloy plating containing 3 to 20 wt % of tin is carried out as described, for example, in Japanese Unexamined Patent Publication (Kokai) No. 52-130438.

On the other hand, a hot-dip plating method is also available for the Zn—Sn alloy plated steel sheet. Because this method can increase relatively easily the deposition quantity of plating, the products produced by this method have been used under severe environments such as fuel tanks and for outdoor use. As to this hot-dip plating method, Japanese Examined Patent Publication (Kokoku) No. 52-35016, for example, discloses an example in which a steel sheet obtained by hot-dip plating of more than 80 to 98 wt % of tin and 2 to less than 20 wt % of zinc is used for fuel tanks of automobiles and oil tanks of kerosine stoves. Japanese Unexamined Patent Publication (Kokai) No. 4-214848 describes a plated article obtained by plating an iron type plated material by Zn—Sn alloy plating containing 70 to 98 wt % of tin, and a production method thereof. Further, Japanese Unexamined Patent Publication (Kokai) Nos. 3-229846 and 5-263208 describe a zinc type plated article obtained by serially plating a tin-containing alloy layer as a hot-dip galvanized layer on an iron type substrate, or a chromium plating layer on an alloy layer containing zinc and aluminum, a production method thereof. Japanese Unexamined Patent Publication (Kokai) Nos. 5-9786 and 6-116749 disclose a steel sheet obtained by serially plating tin and nickel and a second plating layer containing them on nickel, cobalt and a first plating layer containing them, whereby tin and nickel have lower melting points than nickel and cobalt, then conducting plastic forming and thereafter conducting heat-treatment, components made by such a steel sheet, and weldable pipes such as fuel pipings of automobiles.

Further, Japanese Examined Patent Publication (Kokoku) No. 63-66916 discloses a steel sheet for an alcohol-containing fuel, which is obtained by applying a Sn—Zn alloy plating layer to a low carbon steel to which alloy elements such as chromium, aluminum, titanium, niobium, etc., are added.

However, the prior art technologies described above are not free from the following drawbacks.

First of all, while the use of the Pb—Sn plated steel sheet can secure the corrosion resistance requirements for the service life of automobiles, press formability capable of press forming in match with a complicated structure of a car bottom portion and solderability and weldability capable of bonding fuel tank components, the Pb—Sn plated steel sheet contains lead and is not therefore preferable in view of the environmental restrictions such as the restriction of elution of lead from industrial wastes such as shredder dust.

On the other hand, the use of the Sn—Zn plated steel sheet by electroplating described above can improve the solderability and corrosion resistance, but this method involves problems in productivity and economy for the following reason. A plated steel sheet having a greater plating deposition quantity is necessary for environments where long-term corrosion resistance is required, such as a fuel tanks, but because control of the deposition quantity in the electroplating method depends on the time and the magnitude of a current, the deposition quantity can be obtained only by extending the processing time or by passing a greater current, and great problems occur in productivity and economy.

Further, when an iron type substrate is serially plated with a zinc or zinc alloy layer and a chromium plating layer, the corrosion resistance, etc., can be further improved due to the addition of the chromium plating layer, but the thickness of the zinc alloy layer is as great as 5 to 75 $\mu$m, preferably 10 to 50 $\mu$m and further preferably 10 to 30 $\mu$m, and it is difficult to secure the corrosion resistance by the alloy layer. Moreover, because base iron is contained in the alloy layer, press formability remarkably drops, and such a material is not therefore suitable as a fuel tank material.

Next, the problems with the foregoing prior art technologies will be explained in further detail.

Japanese Unexamined Patent Publication (Kokai) Nos. 5-9786 and 6-116749 describe a steel sheet component and a weld pipe having a first plating layer consisting of at least one of Ni, Co and their base alloys and a second plating layer of an Sn—Zn alloy, etc., having a lower melting point than the first plating layer and formed on the first plating layer, whereby the steel sheet component or the weld pipe has a contact portion with the fuel, and a production method of the steel sheet component or the weld pipe. However, because these technologies form the first and second plating layers by an electrical or chemical plating method, heat-treatment after plating is essentially necessary. The main object of this heat-treatment step is to prevent pin-holes from remaining in the first plating layer or cracks occurring with plastic forming, by fusing and fluidizing the second plating layer. Since this heat-treatment is carried out at a high temperature within the range of 600° to 1,200° C., segregation of specific components such as zinc occurs during the cooling process after melting, and there is a large possibility that the corrosion resistance is locally deteriorated.

In contrast, since the present invention employs the hot-dip plating method as will be later described, heat-treatment after plating is not of course necessary. Moreover, since the technical background is entirely different from the very outset, the resulting product and the production method are different, as well. Further, the inventors of the present invention have examined in detail the relationship between the size of the zinc crystals and the corrosion resistance as to the form of zinc in the Sn—Zn alloy plating layer, and have clarified the preferred distribution form of the zinc crystals required for a fuel tank material having excellent characteristics as well as the cooling condition after the plating treatment so as to accomplish such a distribution form. Therefore, the prior art technologies described above do not at all teach or suggest the relation as the important constituent requirement in the present invention.

Japanese Unexamined Patent Publication (Kokai) No. 3-229846 discloses a hot-dip galvanized article obtained by plating a zinc film or a zinc alloy film to an iron type plated article through an alloy layer containing at least iron, zinc and nickel. As to the zinc alloy film, this reference partially describes a molten Zn—Sn alloy plating layer containing at least 30 wt % of tin, but because aluminum is an indispensable component in the zinc alloy film of this reference, it is only in the case of using the Zn—Al alloy as the Zn—Al alloy that a detailed technical explanation is given. Therefore, this reference does not at all give any technical disclosure on the Sn—Zn alloy plating layer which is particularly dealt with in the present invention. Further, because no description is given on the cooling conditions after plating, the growth of macrocrystals of zinc is expected, and there is a large possibility that the corrosion resistance is deteriorated.

Japanese Unexamined Patent Publication (Kokai) No. 4-214848 discloses a hot-dip galvanized article wherein a molten Zn—Sn alloy plating layer (zinc:tin=2 to 30 wt %:98 to 70 wt %) is plated to a to-be-plated article consisting of castings through an alloy layer containing at least iron, zinc and nickel. This reference clearly describes that the technical problem is different between the case where the object is an iron type plated article (higher order concept of steel sheets and castings) and the case where it is a castings, and that particularly in the case of the castings, a Zn—Sn alloy plating film must be formed through an alloy layer which contains at least iron and zinc and in which nickel exists, because the tin content is high and it is difficult to form a Zn—Sn alloy plating film having an excellent corrosion resistance. In other words, when the to-be-plated article is a steel sheet, this reference does not have any concrete description about the alloy layer containing Ni, Fe, Zn and Sn as the constituent requirement of the present invention, and neither teaches nor suggests the relationship between the size of the zinc crystals and the corrosion resistance which has been clarified for the first time by the present invention. Since the characterizing Fe—Zn alloy layers such as the plate-like layer and the prismatic layer are formed in a thickness equal to, or greater than, the thickness of the Zn—Sn alloy plating layer in this reference, the product of this reference presumably is subject to problems of press formability and the corrosion resistance of the press formed portion in the case of application to the fuel tanks where it is exposed to subsequent severe press forming conditions.

Japanese Unexamined Patent Publication (Kokai) No. 5-263208 discloses a zinc type plated article obtained by serially plating an iron type substrate by a molten Zn—Sn alloy plating layer containing at least zinc and tin and a chromium plating layer. However, this reference does not clearly describe the alloy layer containing Ni, Fe, Zn and Sn as the constituent requirement of the present invention, and does not at all describe, either, the distribution form of the zinc crystals. Further, because this reference does not describe the cooling condition after plating, the growth of the macroscopic zinc crystals is expected, and the possibility of degradation of the corrosion resistance is great, too.

Japanese Examined Patent Publication (Kokoku) No. 52-35016 discloses an Sn—Zn type hot-dip plating steel material having an alloy film comprising more than 80 to 98 wt % of tin and 2 to less than 20 wt % of Zn. Though this reference has a technical explanation on the Sn—Zn alloy having a specific composition, it does not at all describe the alloy layer containing Ni, Fe, Zn and Sn as the constituent requirement of the present invention, and does not describe the distribution form of the zinc crystals.

Japanese Unexamined Patent Publication (Kokai) No. 63-66916 discloses a steel sheet for fuel containers comprising a low carbon steel containing alloy elements such as Cr, Al, Ti, Nb, etc., added thereto, a Ni or Co or Ni—Co alloy diffusion layer and an Sn—Zn alloy plating layer. As to the plating method of the Sn—Zn alloy, the reference specification describes "the plating method and the plating condition are not particularly limited". However, because it is the electroplating method that is actually disclosed in the specification, heat-melting treatment of the pin-holes (pore sealing treatment) of the alloy plating layer becomes subsequently necessary in some cases. In contrast, since the present invention employs the hot-dip plating method, the pore-sealing treatment need not naturally be carried out after plating. This reference does not teach or suggest, either, the relationship between the size of the zinc crystals and the corrosion resistance that has been clarified for the first time by the present invention.

As described above, the inventors of the present invention have examined in detail the relationship between the size of the zinc crystals and the corrosion resistance and the form of zinc in the Sn—Zn alloy plating layer, and have clearly stipulated the desirable distribution form of the zinc crystals required for the material for fuel tanks having excellent characteristics and the cooling conditions after plating treatment for accomplishing such a distribution form, but none of the prior art references described above teaches or suggests at all the distribution form of the zinc crystal and the cooling condition after plating as important constituent requirements of the present invention.

DISCLOSURE OF THE INVENTION

In order to solve the problems described above, the inventors of the present invention have made various studies on the structure of the Zn—Sn alloy plating layer, the surface conditions and the base metal composition, the film conditions for improving the corrosion resistance and the optimum production condition of the Zn—Sn alloy plating layer, and have found that optimum performance as the material for fuel tanks can be obtained by employing the construction as stipulated by the present invention.

Particularly, the present inventors have clarified the relation between the size of the zinc crystals and the corrosion resistance in connection with the form of zinc in the Zn—Sn alloy layer. In other words, if the size of the zinc crystals is great, the zinc crystals is likely to be preferentially corroded, the plating layer is therefore corroded locally and useful life till penetration of the plating layer becomes short. When press forming is carried out, the zinc crystals serves as the path for the propagation of cracks, so that the cracks propagate through the plating layer, thereby causing peeling of the plating and promoting the progress of the corrosion to the steel. Therefore, the present inventors have discovered that the precipitation size of the zinc crystals and the number of the zinc crystals per unit area are important factors.

The present inventors have also found that the corrosion resistance and press formability can be remarkably improved by the optimum combination of the surface conditions of the Zn—Sn alloy plating layer, particularly its surface coarseness and corrosion resistance, the improvement of press formability and the base metal composition as the base.

A spangle consisting primarily of tin precipitates as the primary crystal during the cooling process of the Zn—Sn alloy plating layer, but because a large crystal structure (hereinafter called the "spangle") is formed in a gentle cooling process, the needle-shaped crystals of zinc that have grown are primarily and quickly dissolved in the corrosive environment, and cracks are likely to occur with these needle-shaped crystals as the starting point. On the other hand, when ultra-quick cooling is carried out, the spangle becomes fine, so that a large strain is incorporated in the crystals and the corrosion resistance as well as formability may be adversely affected. However, when the steel sheet is formed into the fuel tank, the heat of coating and baking is generally applied and the release of the strain can be expected. Therefore, there is no practical problem. Consequently, the present inventors have found the optimum size of the spangle in addition to the optimum production conditions of the Zn—Sn alloy plating layer.

Further, the present inventors have found an additional plating treatment for further improving the corrosion resistance on the Zn—Sn alloy plating layer described above.

The present inventors have also found the optimum production conditions for obtaining the Zn—Sn plating layer described above.

The first object of the present invention is to provide a rust-proofing steel sheet for a fuel tank characterized in that an alloy layer containing at least one of nickel, iron, zinc and tin is deposited onto the surfaces of the steel sheet to a thickness of not greater than 2 $\mu$m per surface, and a Sn—Zn alloy plating layer which consists of 40 to 99 wt % of tin and the balance of zinc and unavoidable impurities and in which the number of the zinc crystals having a major axis of at least 250 $\mu$m is not greater than 20 crystals/0.25 $mm^2$ is deposited onto the alloy layer to a thickness of 2 to 50 $\mu$m per surface.

It is the second object of the present invention to provide a rust-proofing steel sheet for a fuel tank wherein the surface coarseness Ra (center line mean coarseness) of the Sn—Zn alloy plating layer described above is 0.2 to 3.0 $\mu$m.

It is the third object of the present invention to provide a rust-proofing steel sheet wherein the composition of the base metal on which the Sn—Zn alloy plating layer is applied is a steel containing, in terms of wt %, $C \leqq 0.1\%$, $Si \leqq 0.1\%$, $0.05\% \leqq Mn \leqq 1.2\%$, $P \leqq 0.04\%$, $S \leqq 0.04\%$, $Al \leqq 0.1\%$, at least an atomic equivalent of a (C+N) content to 1.0% of at least one of Ti and Nb and the balance of Fe and unavoidable impurities, and the steel further contains at least one of 0.0002 to 0.0030% of B and 0.2 to 6% of Cr in addition to the composition described above.

Furthermore, the present invention provides a rust-proofing steel sheet for a fuel tank wherein a chromate treatment film is applied to the outside of the Sn—Zn alloy plating layer described above in a quantity of 0.2 to 100 $mg/m^2$, calculated as chromium, per surface and/or an organic-inorganic composite film containing at least one of chromium, silicon, phosphorus and manganese and containing an organic resin primarily consisting of an acrylic resin, a polyester resin or an epoxy resin, in a deposition quantity of 0.01 to 2.0 $g/m^2$.

In order to obtain the Sn—Zn alloy plating layer, the present invention provides the following method.

(1) A production method of a Zn—Sn alloy plated steel sheet which comprises the steps of degreasing and pickling an annealed steel sheet, applying Ni or Ni—Fe alloy pre-plating in a plating amount of 0.1 to 3.0 $g/m^2$ in terms of nickel content per surface, applying a flux containing 2 to 45 wt %, calculated as chlorine, of hydrochloric acid, and carrying out plating by dipping the steel sheet into a bath comprising 40 to 99 wt % of tin and the balance of zinc and unavoidable impurities at a bath temperature of (melting point+20° C.) to (melting point+300° C.) for less than 15 seconds. The deposition quantity is adjusted and the material is further cooled at a cooling rate of at least 10° C./sec.

(2) A production method which comprises the steps of applying Ni or Ni—Fe type pre-plating to an annealed steel sheet in a nickel content of 0.1 to 3.0 $\mu m^2$ per surface, conducting a plating pre-treatment in a non-oxidizing furnace at a maximum sheet temperature of 350 to 650° C., an air ratio of 0.85 to 1.30, a maximum sheet temperature in a reducing furnace of 600° to 770° C., a ratio of retention time in the non-oxidizing furnace to retention time in the reducing furnace of 1 to ⅓, and an outlet temperature of not higher than (dew point−20° C.) at the outlet of the reducing furnace, adjusting the sheet temperature immediately before plating to almost the bath temperature, carrying out plating by dipping the steel sheet in a bath consisting of 40 to 99 wt % of tin and the balance of zinc and unavoidable impurities at a bath temperature of (melting point+20° C.) to (melting point+300° C.) for less than 6 seconds, and cooling the plated steel sheet at a cooling rate of at least 10° C./sec.

(3) A production method of a Zn—Sn alloy plated steel sheet which comprises the steps of conducting pre-plating treatment for a cold-rolled steel sheet at a maximum sheet temperature in a non-oxidizing furnace of 450° to 750° C., an air ratio of 0.85 to 1.30, a maximum sheet temperature in a reducing furnace of 680° to 850° C., a ratio of retention time in the non-oxidizing furnace to retention time in the reducing furnace of 1 to ⅓, and an outlet dew point of not higher than (dew point−25° C.) at the outlet of the reducing furnace, adjusting the sheet temperature immediately before plating to almost the bath temperature, carrying out plating by dipping the plated steel sheet into a bath comprising 40 to 99 wt % of tin and the balance of zinc and unavoidable impurities at a bath temperature of (melting point+20° C.) to (melting point+300° C.) for less than 6 seconds, and cooling the plated steel sheet at a cooling rate of at least 10° C./sec.

BRIEF DESCRIPTION OF THE DRAWINGS

FIG. 1(*b*) is a photograph showing the structure of zinc crystals of an appropriate size in the precipitation size that are observed in the Zn—Sn alloy plating layer obtained by the present invention.

BEST MODE FOR CARRYING OUT THE INVENTION

As described above, the present invention has clarified the relationship between the precipitation size of the zinc crystals within a suitable range in the Sn—Zn alloy plating layer, the number of the zinc crystals per unit area and the corrosion. Hereinafter, the present invention will be explained in detail.

Figure 1A:
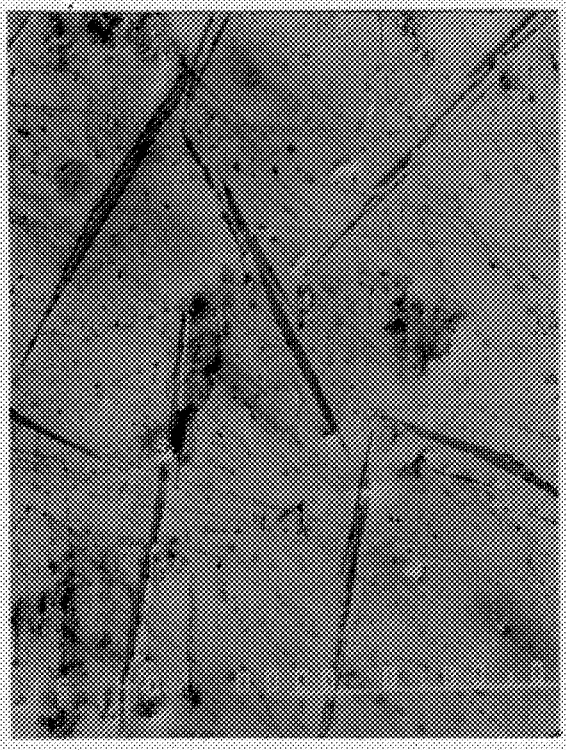
FIG. 1(*a*) is a photograph showing the structure of macroscopic zinc crystals in the precipitation size that are observed in a conventional Zn—Sn alloy plating layer.
Figure 1B:
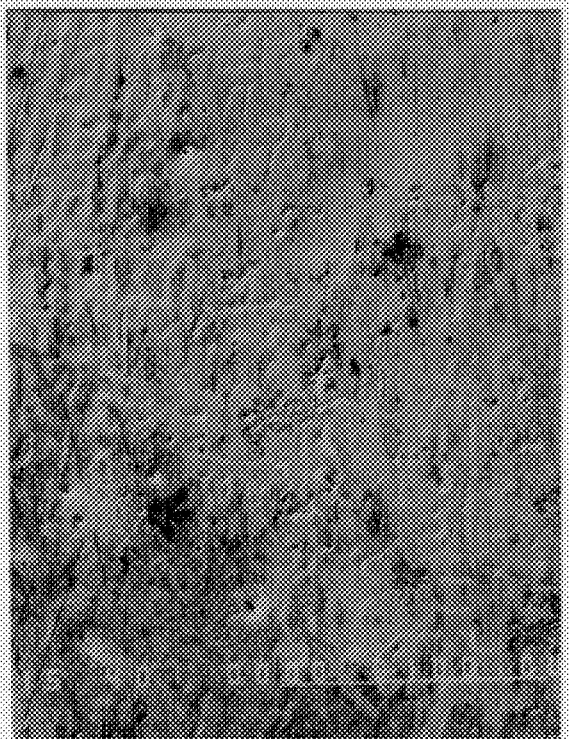
Figure 2:
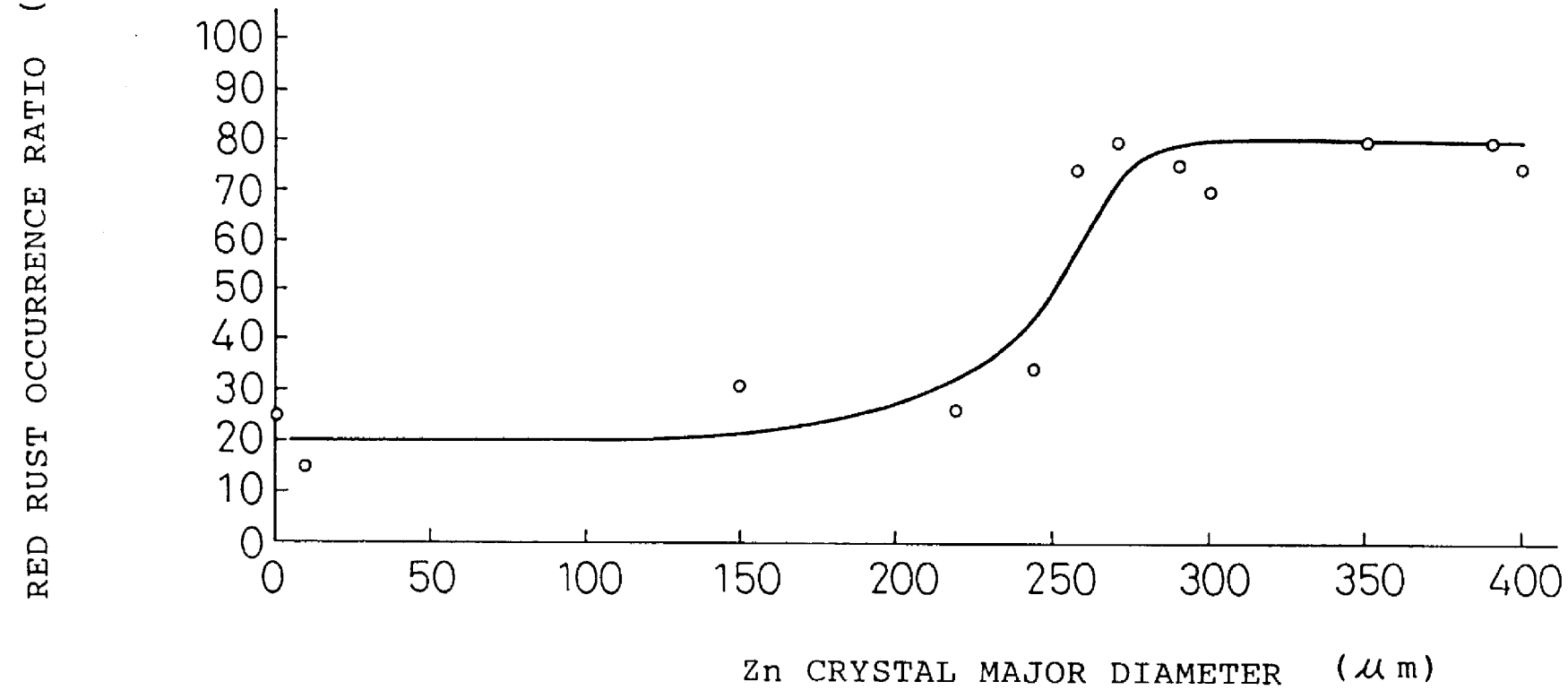
FIG. 2 is a diagram showing the relation between a red rust occurrence ratio of a Sn—Zn plated steel sheet after a brine spray test (SST, 500 hours) and the major diameter ($\mu$m) of the zinc crystals in the Sn—Zn plated material.

FIG. 1 shows a structure photograph relating to the precipitation size of the zinc crystals. FIG. 1(*a*) shows a macroscopic zinc crystal observed in the conventional Zn—Sn alloy plating layer, and its precipitation size is as great as hundreds of microns. As described above, macroscopic zinc crystals are preferentially corroded and induce the propagation of cracks. On the other hand, FIG. 1(*b*) shows the case where zinc crystals having a certain specific size exists per unit area when the corrosion resistance is remarkably improved by the present invention. The relationship between the zinc crystals having a certain specific size per unit area and the corrosion resistance will be explained with reference to FIG. 2. FIG. 2 shows the relationship between a red rust occurrence ratio of the Sn—Zn plated steel sheet after a brine spray test (SST for 500 hours) and the major diameter ($\mu$m) of the zinc crystals of this Sn—Zn plating material. As can be seen clearly from FIG. 2, the red rust occurrence ratio drastically increases when the zinc crystals major diameter exceeds 250 $\mu$m within the range of the number of the zinc crystals of 20 to 210 crystals/0.25 $mm^2$, and red rust occurs at an extremely high frequency in the case of macroscopic zinc crystals as in the prior art. On the other hand, the red rust occurrence ratio is extremely low, lower than 40%, outside the range described above. Thus, it is important that zinc crystals having a suitable size exists per unit area in the Sn—Zn alloy plating layer. It has been found that the precipitation of zinc crystals is such that the crystals having a major diameter of not smaller than 250 $\mu$m exist in a number of not greater than 20 crystals/0.25 $mm^2$.

On the basis of the findings described above, the present inventors have discovered the optimum conditions for obtaining the Sn—Zn alloy plating layer.

An annealed steel sheet obtained by conducting heat-treatment and rolling such as hot rolling, pickling, cold rolling, etc., or a rolled material, is used as a raw sheet for plating, and after pre-treatment such as the removal of a rolling oil, etc., plating is carried out.

As to the alloy structure in the proximity of the steel, a structure containing a steel component-plating component occurs at the boundary with the steel if pore-closing treatment, etc., is carried out by heating after hot-dip plating or electroplating. This structure will be hereinafter called the "alloy layer". This alloy layer contains at least one kind of nickel, iron, zinc and tin. Since these components are not easily corroded by fuels such as gasoline, a greater thickness of the alloy layer is more advantageous for securing a long-term corrosion resistance. From the aspect of securing severe formability suitable for complicated shapes for lower portions of automobiles, however, cracks occur in the alloy layer at the time of forming because the hardness of this structure is high. Further, when the thickness of this alloy layer is greater than a certain thickness, the cracks propagate into the plating layer at the upper portion of the alloy layer and breakage occurs in the plating layer. Therefore, degradation of the corrosion resistance due to peeling of the plating and damage of the plating layer might occur. To cope with this problem, the present invention limits the thickness of the alloy layer to not greater than 2 $\mu$m. However, in some cases, the thickness of the alloy layer is preferably smaller than 1.5 $\mu$m when the particular plating portion is anticipated by steel components, etc.

It is necessary for the plating layer having a composition containing tin and zinc to provide the tank inner surface with resistance to corrosion due to fuel such as gasoline, and the outer surface with resistance to corrosion due to salt, occurring when driving in areas where snow melting salt is used, press formability allowing forming of the steel sheet to match the structure of the lower portions of automobiles, and weldability allowing bonding of the steel sheet to components such as a fuel pipe. When the tin content in the plating layer is smaller than 40%, the tank inner surface corrosion resistance drastically drops, the dissolution speed of the plating layer becomes great, and the dissolution speed of the plating layer in an environment subject to salt corrosion becomes great, too, and the corrosion resistance drops drastically. As the zinc content becomes great, press formability of the plating layer drops. Furthermore, as the zinc content becomes great, solderability drastically drops. When the tin content in the plating layer becomes greater than 99%, the sacrificial corrosion proofing effect provided by the plating layer in an environment subject to salt corrosion becomes low, though performance does not particularly drop, and when scratches, etc., develop, iron rust is likely to occur from the base. Therefore, the present invention stipulates the composition for the plating layer to be 40 to 99 wt % of tin and the balance of zinc and unavoidable impurities. However, the tin content must be increased when the particular plating portion is limited by steel components, etc., such as when severe formability is required, and in such a case, a tin content of 80 to 99 wt % becomes preferred.

The thickness of the plating layer affects the corrosion resistance. If the thickness is too small, the corrosion proceeds to the base within a relatively short period in the course of extended use of the plated steel sheet, the fine pin-holes generated at the time of plating are not covered but are exposed, and the corrosion of the base therefore occurs more quickly than the life estimated from the plating thickness. If the plating thickness is too great, on the other hand, while the corrosion resistance can be sufficiently secured, but the plating performance becomes excessive. By the way, solderability depends on the plating deposition quantity. If the deposition quantity is extremely small, solderability is likely to be affected by the base and is reduced. Therefore, the plating thickness is preferably 4 to 50 $\mu$m per surface. However, even a plating thickness of 2 $\mu$m can secure sufficient corrosion resistance if measures are taken so as to reduce plating damage during plating by paying specific attention to the surface lubricating property and the forming method. Therefore, the plating thickness is set to 2 to 50 $\mu$m per surface.

Next, coarseness is associated with the surface lubricating property, and exerts great influence on the coefficient of friction and on the oil retaining property. A rust-proofing oil is applied to the steel sheet at the time of pressing of the actual tank and at least at the time of shipment of products, and the oil retaining property becomes important. The greater the coarseness Ra, the higher becomes the oil retaining property, but when the coarseness Ra is too great, the effect reaches saturation and the plating thickness becomes non-uniform locally after forming, so that, to the contrary the corrosion resistance is adversely affected. Accordingly, the upper limit of the coarseness is set to Ra 3.0 $\mu$m. On the other hand, if the coarseness is less than 0.2 $\mu$m, the oil retaining property of the present plating composition drastically drops, and the surface lubricating property is deteriorated. In view of these facts, the coarseness is set to 0.2 to 3.0 $\mu$m.

When press formability is taken into consideration in connection with the coefficient of friction, the plating layer composition, post-treatments for improving various kind of performance such as the corrosion resistance, the kind of surface films inclusive of the coating oil, surface evenness, etc., affect the coefficient of friction, and depending on the coefficient of friction, various problems occur such as cracks in the plating layer, wear and loss of the plating layer and reduced corrosion resistance. In consideration of these factors, the coefficient of kinetic friction is preferably not greater than 0.3 after the application of the oil in the Zn—Sn composition of the present invention.

Furthermore, the inventors of the present invention have conducted intensive studies on steel components, plating layer structures, constructions, and so forth in order to provide a rust-proofing steel sheet for fuel tanks not containing lead (with the exception of unavoidable impurities), and have found that the materials according to the structure of the present invention satisfy the performance requirements for fuel tank materials.

A rust-proofing steel sheet for a fuel tank which is:

(1) a steel sheet containing, in terms of wt %, C≦0.1%, Si≦0.1%, 0.05%≦Mn≦1.2%, P≦0.04% and Al≦0.1%, or (2) a steel sheet containing, in terms of wt %, C≦0.1%, Si≦0.1%, 0.05%≦Mn≦1.2%, P≦0.04%, Al≦0.1%, at least one of Ti and Nb in an amount greater than the atomic equivalent of the (C+N) content to 1.0% and 0.0002 to 0.0030% of B; wherein an alloy layer containing at least one of Ni, Fe, Zn and Sn is deposited on the steel sheet to a thickness of not greater than 1.5 μm per surface, and a Sn—Zn alloy layer consisting of 40 to 99 wt % of tin and the balance of zinc and unavoidable impurities, and containing not greater than 20 crystals/0.25 $mm^2$ of zinc crystals having a major diameter of at least 250 μm as viewed from the surface is deposited on the alloy layer described above to a thickness of 2 to 50 μm per surface.

Further, the present invention provides a rust-proofing steel sheet for a fuel tank which is:

(3) a steel containing, in terms of wt %, C≦0.08%, Si≦0.1%, 0.05%≦Mn≦1.5%, P≦0.035%, Al≦0.1% and 0.2≦Cr≦6%, or (4) a steel containing, in terms of wt %, C≦0.08%, Si≦0.1%, 0.05% ≦Mn≦1.5%, P≦0.035%, Al≦0.1%, 0.2≦Cr≦6%, 0.0002 to 0.0030% of B and at least one of Ti and Nb in an amount greater than the atomic equivalent of the (C+N) content to 1.0%; wherein an alloy layer containing at least one of nickel, iron, chromium, zinc and tin is deposited to the steel sheet to a thickness of not greater than 1.5 μm per surface, and a Sn—Zn alloy layer consisting of 40 to 99 wt % of tin and the balance of zinc and unavoidable impurities and containing not greater than 20 crystals/0.25 $mm^2$ of zinc crystals having a major diameter of at least 250 μm as viewed from the surface is deposited on the alloy layer described above to a thickness of 2 to 50 μm per surface.

The steel components must have a component system allowing the steel sheet to be formed into complicated shapes of the fuel tank, must be able to reduce the thickness of the alloy component layer of the tin-zinc boundary surface to minimum and must be a component system which restricts the progress of corrosion in the internal environment of a fuel tank and in the external environment. Hereinafter, the steel components will be explained in detail.

To secure strength, a certain content of C is necessary. In the plating bath components of the present invention, C is an element which lowers formability and the corrosion resistance, but is advantageous for securing plating adhesion at the time of press forming because it functions as an element which restricts the reaction of the steel-plating layer boundary. Therefore, the C content is limited to C≦0.1% in terms of wt %.

Since Si stabilizes the oxide film of the steel surface, it is likely to remain when the steel sheet of the present invention is dipped in the plating bath having the bath components of the present invention, to restrict the plating reaction and to form large quantities of pin holes (unplated portions) that adversely affect the corrosion resistance. Though Si must be contained in a certain amount to secure strength, its content must be adjusted because it is one of strength reinforcing elements. In the plating bath components of the present invention, Si functions as the element that restricts the steel-plating layer boundary reaction, and is therefore advantageous for securing adhesion of plating at the time of press forming. In view of these factors, the Si content is set to Si≦0.1% in terms of wt %.

Mn must be contained in a certain amount so as to secure strength. Because it is a strength reinforcing element, however, Mn is likely to lower formability and its content must be limited. In the plating bath of the present invention, Mn is likely to improve reactivity and to promote the steel-plating layer boundary reaction. Therefore, the Mn content must be adjusted to regulate the boundary reaction. In view of these factors, the Mn content is limited to 0.05%≦Mn≦1.2% in terms of wt %.

P has the effect of restricting the reaction in the plating bath, and is a necessary component for restricting the steel-plating layer boundary reaction. If its content is too great, however, large quantities of pin holes are formed. In view of these factors, P is limited to 0.04%≦P in terms of wt %.

Al has the effect of restricting the reaction in the plating bath, and is a necessary component for restricting the steel-plating layer boundary reaction. If its content is too great, however, platability drops drastically, and pin holes are likely to occur. Therefore, the upper limit of the Al content must be limited to 0.1% in terms of wt %.

Nb and Ti are necessary elements for fixing N and imparting formability to the steel sheet. When contained in an amount at least equal to the atomic equivalent of (C+N), they can fix C and N. When their content exceeds 1.0%, the effect reaches saturation, and in the plating bath of the present invention, Nb and Ti are likely to promote the steel-plating layer boundary reaction. Therefore, from the aspect of the adjustment of the boundary reaction, too, their content must be adjusted. In view of these factors, at least one of Ti and Nb is at least the atomic equivalent of the (C+N) content and the upper limit is set to 1.0% in terms of wt %.

B precipitates in grain boundary to thereby improve a strength of the grain boundary, and is necessary for preventing the secondary forming cracks and improving formability. If its content is too great, however, its effect reaches saturation and its strength in high temperature becomes so high that hot rollability drops. Therefore, its content is limited to 0.0002% to 0.0030% in terms of wt %.

Cr improves a strength but is likely to lower formability and plating ability. However, Cr has the effect of drastically improving the corrosion resistance of the steel. In the plating layer composition of the present invention, the addition of even a relatively trace amount of Cr can obtain a sacrifice corrosion-proofing effect, and the corrosion resistance improving effect is greater than for conventional, ordinary steels. Therefore, the Cr content must be adjusted in consideration of formability, plating ability and the corrosion resistance, and is limited to 0.2≦Cr≦6% in terms of wt %.

Next, in order to provide a rust-proofing steel sheet for a fuel tank not containing lead (exclusive of unavoidable impurities), the inventors of the present invention have conducted intensive studies on various plating compositions, film structures and constructions, and have developed a rust-proofing steel sheet for a fuel tank having excellent press formability and corrosion resistance which is a Sn—Zn alloy plated steel sheet containing 40 to 99 wt % of tin, and wherein a plating structure having a major diameter of spangles on the outermost surface of not greater than 20.0

μm is applied through an alloy layer having a thickness of not greater than 2.0 μm.

Generally, a small crystal structure (which will be hereinafter called the "spangle") appears when cooling is carried out extremely quickly. However, because a large strain is incorporated in the structure, the corrosion resistance as well as formability might drop. On the other hand, when cooling is gradually carried out after plating, a spangle consisting principally of tin is formed, and the problem of the thermal strain disappears. However, the large crystals undesirably function as the starting point of the occurrence of cracks during forming.

For the reasons described above, the present invention stipulates also the size of the spangle.

The size of the spangle can be defined by the length of the major diameter of the crystal. Generally, round spangles are formed in many cases, but because the length of the major diameter of the crystal is not always equal to the length of the minor diameter, the present invention defines the size of the spangle by the length of the major diameter.

From the aspects of the corrosion resistance and formability, further, the present invention limits the length of the major diameter of the crystal to preferably not greater than 20 mm and more preferably not greater than 10 mm for a spangle after plating. In the case of coarse crystals having a length of the major diameter of the crystal of greater than 20 mm, the spangles function as the starting point of the occurrence of cracks during forming as described above.

Fine crystals having a length of the major diameter of the crystal of not greater than 1.0 mm incorporate a large thermal strain and might lead to problems. However, because heat is ordinarily applied in operations such as painting or baking to the steel sheet during its press forming into a fuel tank, the release of this strain can be expected, and there is no practical problem.

A chromate treatment film is further disposed on the plating layer. This chromate treatment film has extremely high compatibility with the plating layer having the composition of the present invention, covers defects such as very small pin holes, dissolves the plating layer to repair the pin holes and thus drastically improves the corrosion resistance. Therefore, the lower limit value of this chromate treatment film as the value for improving the corrosion resistance is set to 0.2 $mg/m^2$ when calculated in terms of chromium. The upper limit value of the deposition quantity of this treatment film is preferably high in consideration of the corrosion resistance and resistance weldability, and is set to 100 $mg/m^2$ when calculated in terms of chromium. If the deposition quantity is greater than 100 $mg/m^2$, the effect reaches saturation, and the film is colored leading to deteriorated appearance. When solder bonding is employed, however, solderability drops if the deposition quantity is great and for this reason, the deposition quantity of not greater than 25 $mg/m^2$ is preferred, when calculated in terms of chromium.

The present invention has also developed a rust-proofing steel sheet for a fuel tank having excellent formability, corrosion resistance and weldability which has an organic-inorganic composite film having a deposition quantity of 0.01 to 2.0 $g/m^2$ on the surface of an Sn base alloy plating layer in place of the chromate treatment film described above.

The Sn base alloy plating layer described above may contain at least one of not greater than 20% of Zn, not greater than 5% of Cr, not greater than 5% of Mn, not greater than 5% of Ti, not greater than 5% of Al, not greater than 5% of Cd and not greater than 5% of Mg in the sum of not greater than 20%, and the balance of Sn and unavoidable impurities.

The organic-inorganic composite film may contain at least one of chromium, silicon, phosphorus and manganese compounds in the sum of at least 20 wt %, or an organic resin of the organic-inorganic composite film may be at least one of acrylic, polyester and epoxy types.

In the present invention, the film of the outermost layer has a very important role of governing the corrosion resistance, weldability, solderability and brazability. Therefore, it is important to further improve these characteristics.

Spot welding and seam welding are electric resistance welding methods which use a copper base alloy as an electrode, and the tin base alloy as the plating metal of the present invention easily reacts with the copper base alloy of the electrode due to the heat of welding and might deteriorate the electrode life. If this problem can be solved, the plated steel sheet of the present invention can be regarded as a material having all of the characteristics of excellent formability, corrosion resistance and weldability.

The present invention improves spot weldability and seam weldability by depositing the organic-inorganic composite film containing at least one of chromium, silicon, phosphorus and manganese in the deposition quantity of 0.01 to 2.0 $g/m^2$ on the metal plating described above.

Preferred examples of the base resin for the organic resin film are acrylic, polyester and epoxy resins that have excellent adhesion with the metal. These resins are used as a solvent type or a water soluble type and in the form of the organic-inorganic composite resin containing at least one of chromium, silicon, phosphorus and manganese compounds.

The chromium compound is added in the form of chromic acid or a chromate so as to improve the rust-proofing function. The silicon compound is added as silicon oxides or silicon fluorides so as to improve the film characteristics. The phosphorus compound is added as organic or inorganic phosphoric acids or phosphates to improve adhesion, corrosion resistance and weldability of the film. The manganese compound is added so as to primarily improve the rust-proofing function in the same way as the chromium compound.

The mixing ratio of these compounds with the resin is not particularly limited, but when the improvement in weldability is the main object, the mixing ratio of the organic resin is not greater than 80% (in terms of the weight ratio) and preferably, not greater than 50%.

The adhesion quantity is within the range of 0.01 to 2.0 $g/m^2$ as the total weight and preferably, within the range of 0.02 to 0.50 $g/m^2$. The lower limit value of 0.001 $g/m^2$ represents the limit at which the improvement in the corrosion resistance and weldability can be observed, and the upper limit value of 2.0 $g/m^2$ represents the limit of the occurrence of sputter due to local abnormal exothermy at the time of welding.

Next, the production condition for obtaining the Zn—Sn alloy plated layer as the object of the present invention will be described. The production method of molten plating can be broadly classified into a flux plating method and a plating method by annealing, and the plating method by annealing can be further divided into an oxidation/reduction method and a total reduction method. Since all of these methods activate the surface before plating, they can be applied to the alloy plating system according to the present invention. Hereinafter, the present invention will be described in detail for the flux method and the oxidation/reduction method. The production method according to the present invention comprises the steps of applying nickel or Ni—Fe type preplating to an annealed steel sheet to 0.1 to 3.0 g/m$^2$ per surface in terms of the nickel content, applying then a flux containing hydrochloric acid in 2 to 45 wt % calculated as chlorine, conducting plating by immersing the steel sheet into a plating bath consisting of 40 to 99 wt % of tin and the balance of lead and unavoidable impurities at a bath temperature of (melting point+20° C.) to (melting point+300° C.) for less than 15 seconds, and cooling the plated sheet at a cooling rate of at least 10° C./sec.

The present invention provides also a production method of a Zn—Sn alloy plated steel sheet comprising the steps of applying Ni or Ni—Fe type pre-plating to an annealed steel sheet in a nickel content of 0.1 to 3.0 g/m$^2$ per surface, conducting a plating pre-treatment in a non-oxidizing furnace at a maximum sheet temperature of 350° to 650° C., an air ratio of 0.85 to 1.30, a maximum sheet temperature in a reducing furnace of 600° to 770° C., a ratio of retention time in the non-oxidizing furnace to retention time in the reducing furnace of 1 to ⅓ , and an outlet dew point of not higher than −20° C. at the outlet of the reducing furnace, adjusting the sheet temperature immediately before plating to almost the bath temperature, carrying out plating by immersing the steel sheet in a bath consisting of 40 to 99 wt % of tin and the balance of zinc and unavoidable impurities at a bath temperature of (melting point+20° C.) to (melting point+300° C.) for less than 6 seconds, and cooling the plated steel sheet at a cooling rate of at least 10° C./sec. Alternatively, the present invention provides a production method of a Zn—Sn alloy plated steel sheet comprising the steps of conducting pre-plating treatment for a cold-rolled steel sheet at a maximum sheet temperature in a non-oxidizing furnace of 450° to 750° C., an air ratio of 0.85 to 1.30, a maximum sheet temperature in a reducing furnace of 680 to 850° C., a ratio of retention time in the non-oxidizing furnace to retention time in the reducing furnace of 1 to ⅓, and an outlet dew point of not higher than −25° C. at the outlet of the reducing furnace, adjusting the sheet temperature immediately before plating to almost the bath temperature, carrying out plating by immersing the plated steel sheet into a bath comprising 40 to 99 wt % of tin and the balance of zinc and unavoidable impurities at a bath temperature of (melting point+20° C.) to (melting point+300° C.) for less than 6 seconds, and cooling the plated steel sheet at a cooling rate of at least 10° C./sec.

In Zn—Sn plating, wettability drops with an increasing content of zinc in tin and because wettability is low near the eutectic point of the zinc content of 8.8 wt %, wettability of the steel sheet and the Zn—Sn alloy plating bath must be increased. In order to improve wettability, it is necessary to elevate the bath temperature, to retard the sheet passing rate and to carry out pre-treatment for activating the sheet surface. Among them, the pre-treatment for activating the steel sheet surface is particularly important.

Pre-plating, the kind of the flux and plating condition are important factors for the pre-treatment. In pre-plating, Ni or a Ni—Fe type pre-plating provides an extremely great wetting effect in combination with the Zn—Sn alloy plating bath. However, plating is possible without pre-plating if the kind of flux, the plating conditions, etc., are controlled. As to the deposition quantity, platability is not sufficient if it is less than 0.1 g/m$^2$ in terms of the nickel content, so that the wettability improving effect is small. If the deposition quantity exceeds 3.0 g/m$^2$, wettability reaches saturation, and a thick alloy layer is formed on the boundary between the plating layer and the steel, so that adhesion of the plating drops when the steel sheet is shaped into a tank. Therefore, the plating quantity is limited to 0.1 to 3.0 g/m$^2$ in terms of the nickel content.

As to the flux, those fluxes which contain chlorine ions such as $ZnCl_2$, HCl, etc., are found effective for improving wettability. If the chlorine conversion quantity of the flux is less than 2 wt %, solubility of the oxide film on the surface of the to-be-plated material is so low that the improving effect of wettability is low. If it exceeds 45 wt % and the concentration is high, the effect reaches saturation, and the quantity of the use of the chemical becomes uneconomically high. When preferably at least 0.1% of HCl is added in this case, the oxide film on the surface of the to-be-plated material becomes likely to be dissolved and wettability can be further improved. Therefore, 2 to 45 wt % of the flux, calculated as chlorine, containing hydrochloric acid is applied.

The application range of the bath temperature is considerably broad, but a higher bath temperature is more preferable for wettability. Reactivity is low when the bath temperature is less than (melting point+20° C.), and inferior plating and adhesion defects are likely to occur. If the bath temperature is higher than (melting point+300° C.), on the other hand, wettability reaches saturation and the plating is likely to flow, so that defects in the appearance are likely to occur. Therefore, the bath temperature is limited to (melting point+20 C.) to (melting point+300° C.).

The immersion time in the bath is associated with the degree of reactivity between the plating bath and the steel, and a longer immersion time is more advantageous for securing the corrosion resistance because the alloy layer becomes thicker. However, because plating adhesion drops at the time of forming, on the contrary, the alloy layer must be made as thin as possible for the fuel tank. Therefore, the alloy layer is preferably thin to such an extent that plating adhesion can be secured, and the upper limit of the immersion time is set to less than 15 seconds.

As to the bath components, when the zinc content is greater than 60 wt %, the corrosion resistance, inside the fuel tank, for example to degraded gasoline, and solderability might be insufficient in consideration of the corrosion resistance of the inner and outer surfaces of the fuel tank, plating adhesion at the time of forming, solderability and weldability. If the zinc content is less than 1 wt %, the corrosion resistance of the tank outer surface might be insufficient because the zinc content is small. Therefore, the bath is limited to 40 to 99 wt % of tin and the balance of zinc and unavoidable impurities.

As to the cooling rate, when the zinc content in the plating bath is greater than 8.8 wt % as shown in FIG. 1(*a*), coarse zinc crystals precipitate during the cooling process after plating if the cooling rate is less than 10° C./seconds. Therefore, cracks of the plating layer at the time of forming and local corrosion of the tank inner/outer surfaces due to preferential corrosion of the coarse zinc crystals might occur.

Depending on the cooling rate, further, the spangles consisting principally of tin can grow. If the major diameter of the spangle is greater than 20 mm, the spangle functions as the starting point of the occurrence of cracks at the time of forming, and the major diameter must be limited to not greater than 20 mm. To accomplish this object, the cooling rate must be set to at least 10° C./sec.

When the zinc content is greater than 8.8 wt %, the cooling rate is preferably limited to at least 20° C./sec.

Furthermore, the present invention stipulates the pre-plating conditions and the furnace operation conditions as the pre-treatment method, and its concrete methods are as follows.

(1) A production method of a Zn—Sn alloy plated steel sheet comprising the steps of applying Ni or Ni—Fe type pre-plating to an annealed steel sheet in a plating quantity of 0.1 to 3.0 g/m$^2$ in terms of the nickel content, carrying out plating pre-treatment inside a non-oxidizing furnace at a maximum sheet temperature of 350° to 650° C., an air ratio of 0.85 to 1.30, a ratio of retention time inside the non-oxidizing furnace to retention time in a reducing furnace of 1 to ⅓ and an outlet dew point of the reducing furnace of not higher than −20° C., immersing the steel sheet in a plating bath comprising 40 to 99 wt % of tin and the balance of zinc and unavoidable impurities at a bath temperature of (melting point+20° C.) to (melting point of 300° C.) of the plating bath metal for an immersion time of less than 6 seconds after the sheet temperature immediately before plating is adjusted to almost the bath temperature, and cooling the steel sheet so plated at a cooling rate of at least 10° C./sec.

(2) A production method of a Zn—Sn alloy plated steel sheet comprising the steps of carrying out plating pre-treatment for a cold-rolled steel sheet at a maximum sheet temperature of 450° to 750° C. inside a non-oxidizing furnace, an air ratio of 0.85 to 1.30, a maximum sheet temperature of 680° to 850° C. inside a reducing furnace, a ratio of retention time inside the non-oxidizing furnace to retention time in the reducing furnace of 1 to ⅓ and a reducing furnace outlet dew point of not higher than −25° C., carrying out plating by immersing the steel sheet, after the sheet temperature immediately before plating is adjusted to almost the bath temperature, into a plating bath comprising 40 to 99 wt % of tin and the balance of tin and unavoidable impurities at a bath temperature of (melting point+20° C.) to (melting point+300° C.) of the plating metal for an immersion time of less than 6 seconds, and then cooling the steel sheet at a cooling rate of at least 10° C./sec.

As the pre-treatment method, pre-plating and the furnace operating conditions influence to the pre-treatment. Since Ni or a Ni—Fe type of pre-plating easily forms an alloy consisting principally of iron, nickel, tin and zinc in the combination with the Zn—Sn alloy plating bath, the wettability improving effect is extremely great. Since platability is not sufficient if the deposition quantity is less than 0.1 g/m$^2$ in terms of the nickel content, the wettability improving effect is small. When the deposition quantity exceeds 3.0 g/m$^2$, wettability reaches saturation and at the same time, a thick alloy layer is formed on the boundary surface of the steel with the plating layer, so that adhesion of plating when the steel sheet is shaped into the tank drops. Therefore, the pre-plating quantity is limited to 0.1 to 3.0 g/m$^2$.

Because the pre-plating metal of the pre-plating material is subjected to high temperature, the furnace operating conditions must be chosen so that large quantities of the pre-plating metal are diffused into the steel and the pre-plating quantity on the outermost surface drops remarkably, thereby lowering the wettability with the original object bath. Therefore, the furnace operating conditions must be set so that the diffusion quantity of the pre-plating metal into the steel can be restricted and reactivity in the Zn—Sn type bath can be secured. The non-oxidizing furnace temperature, the air ratio, the reducing furnace temperature, the ratio of the non-oxidizing furnace temperature to the reducing furnace retention time and the dew point have a close mutual correlation. Therefore, it is necessary to set them to the optimum conditions so that the surface conditions of the plating raw sheet when it enters the plating bath remain in the state in which the oxide film is partially left, or in the state in which the surface of the oxide film is active even though the oxide film remains, so as to improve wettability in the Zn—Sn plating bath having extremely low reactivity.

The non-oxidizing furnace temperature affects the thickness of the resulting oxide film in the furnace and the maximum attainable temperature of the sheet. If this temperature is less than 350° C., the thickness of the resulting oxide film is small but the maximum attainable temperature of the sheet becomes low, too. In consequence, reduction becomes insufficient and reactivity with the bath lowers, too. When the furnace temperature exceeds 650° C., the maximum attainable temperature becomes high, too, and diffusion of the pre-plating metal into the steel might occur. Therefore, the maximum sheet temperature in the non-oxidizing furnace is limited to 350° to 650° C. The air ratio is a ratio of the quantity of air used to the quantity of a stoichiometric combustion air, and affects the thickness of the oxide film and its quality. Since special steels containing large quantities of chromium, etc., such as stainless steels are not hereby considered, the thickness of the iron and nickel type oxide films formed in the non-oxidizing furnace are mainly adjusted. Within the range of the air ratio of 0.85 to 1.30, a good balance can be attained with the following reducing furnace conditions, and the surface of the plating original sheet after passing through the reducing furnace is in the optimum state for securing wettability with the original plating bath.

The reducing furnace temperature influence wettability and material secured by the reduction of the oxide film formed in the non-oxidizing furnace. Since the present invention uses annealed material, however, the material is secured, and only wettability needs to be secured. If the reducing furnace temperature is less than 600° C., the reduction is not sufficient and a considerable quantity of the oxide film remains, so that the surface is inactive and reactivity with the bath cannot be sufficiently secured. If the temperature exceeds 770° C., diffusion of the pre-plating metal into the steel is likely to occur, and the excessive reaction by the pre-plating metal might occur. Therefore, the maximum sheet temperature in the reducing furnace is set to 600° to 770° C.

The time ratio of the retention time in the non-oxidizing furnace to the retention time in the reducing furnace governs whether the oxide film formed in the non-oxidizing furnace can be sufficiently reduced in the reducing furnace. When the ratio is smaller than ⅓, the reducing time is long enough that iron and nickel type oxides on the surface of the plated sheet are sufficiently reduced and the surface can be activated. However, the retention time in the reducing furnace is also so long that diffusion of the pre-plating metal into the steel might occur. When the ratio is greater than 1, the oxide film formed in the non-oxidizing film cannot be sufficiently reduced and activated, so that a reduction in wettability might occur. Therefore, the ratio of the non-oxidizing furnace retention time to the reducing furnace retention time is set to ⅓ to 1.

The dew point inside the reducing furnace is important in determining whether the atmosphere can reduce the oxide film, and the atmosphere must be capable of reducing the iron and nickel type oxides. Though the iron and nickel type oxide films are more reducible than an iron type oxide film, the film cannot be reduced sufficiently when the dew point at the outlet of the reducing furnace is higher than −20° C. even when attempts are made to obtain the optimum combination with the furnace operating condition. In consequence, large quantities of the oxide films remain and wettability cannot be secured sufficiently. Therefore, the dew point at the outlet of the reducing furnace is set to not higher than −20° C. Though hydrogen in the reducing furnace is essentially necessary for the reduction, large quantities of hydrogen need not be introduced, and about 5 to about 20% of hydrogen in terms of the reducing furnace outlet concentration is preferred.

Next, the furnace-operating condition when cold-rolled sheets are used as the raw sheet will be explained. Cold-rolled sheets are annealed to secure a formable material characteristics and at the same time, to secure excellent wettability in the plating bath. If the non-oxidizing furnace temperature is less than 450° C., the maximum attainable sheet temperature in the reducing furnace becomes low and recrystallization does not proceed sufficiently, so that it would be difficult to secure sufficient quality. If it exceeds 750° C., the maximum sheet temperature in the reducing furnace becomes excessively high, and deterioration of the material property due to coarsening of the crystal grains and reduced wettability due to surface enrichment of the tin oxide in the steel might occur. Further, large quantities of oxide films are formed on the surface of the plated sheet while it passes through the non-oxidizing furnace and exerts adverse influence on the wettability. Therefore, the maximum sheet temperature in the non-oxidizing furnace is set to 450° to 750° C. On the other hand, if the reducing furnace temperature is less than 680° C., the oxide film remains to a considerable extent, and activity becomes insufficient. In consequence, reactivity with the bath cannot be secured and recrystallization does not proceed sufficiently, either, so that the quality becomes inferior.

When the temperature exceeds 850° C., deterioration of the material due to coarsening of the crystal grains and the reduced wettability due to surface enrichment of the tin oxide in the steel might occur. Therefore, the maximum sheet temperature in the reducing furnace is limited to 680° to 850° C. Since the dew point inside the reducing furnace establishes the atmosphere capable of reducing the iron type oxides formed in the non-oxidizing furnace, the dew point must be further lowered than that of the iron and nickel type oxide films having high reducibility. Therefore, the dew point at the outlet of the reducing furnace is set to not higher than −25° C.

Next, the bath components will be explained. When the zinc content is greater than 60 wt %, the corrosion resistance inside the fuel tank due to degraded gasoline, etc., and solderability, might decrease in consideration of the corrosion resistance of the inner and outer surfaces of the fuel tank, adhesion of plating at the time of forming, solderability, weldability, and other fundamental performance requirements for the gasoline tank. When the zinc content is less than 1 wt %, a drop in the corrosion resistance of the outer surface of the tank might occur because the zinc content is too small. Therefore, the bath components are limited to a composition consisting of 40 to 99 wt % of tin and the balance of zinc and unavoidable impurities.

The bath temperature has a considerably broad range, but a higher bath temperature is more advantageous for wettability. When the bath temperature is less then (melting point+20° C.) of the metal in the plating bath, reactivity is so low that inferior plating and inferior adhesion of plating are likely to occur and at the same time, the fluidity of the bath will be so low that appearance defect are likely to occur. When the bath temperature exceeds, (melting point+300° C.), wettability reaches saturation and the alloy layer formed inside the bath becomes thick, or plating is likely to flow and lead to appearance defects. Therefore, the plating bath temperature is limited to (melting point+20° C.) to (melting point+300° C.) of the metal in the plating bath.

The immersion time in the bath is associated with the degree of reactivity of the plating bath and the plating raw sheet. In the production method according to the present invention, it is believed that the oxide film hardly exists on the surface of the raw sheet immediately before entering the plating bath, or only a slight amount of an extremely active oxide film remains, and the film is not partially formed state, and this state provides reactivity with tin-zinc. When the immersion time is long, the resulting alloy layer becomes thick and a longer immersion time is more advantageous for securing the corrosion resistance. However, since a thick alloy layer leads to reduced adhesion of the plating at the time of forming, the alloy layer must be made as thin as possible for the fuel tank applications. Therefore, the alloy layer is preferably thin sufficiently thin to secure adhesion of plating, and the upper limit of the immersion time is limited to less than 6 seconds in consideration of the surface condition of the active plating raw sheet.

Next, the cooling rate will be explained. When the zinc content in the plating bath is greater than 8.8 wt %, coarse zinc crystals precipitate in the subsequent cooling process when the cooling rate is less than 10° C./sec. Therefore, plating cracks at the time of machining and local corrosion of the tank inner and outer surfaces might occur due to preferential corrosion of the coarse zinc crystals. Depending on the cooling rate, further, the spangle consisting principally of tin grows. When the major diameter of spangle exceeds 20 mm, the spangle functions as the starting point of the occurrence of cracks at the time of machining, and the major diameter must be limited to not greater than 20 mm. For this purpose it is necessary to limit the cooling rate to at least 10 °C./sec. When the zinc content is greater than 8.8 wt %, the cooling rate is preferably at least 20° C./sec.

EXAMPLES

The material property characteristics of the rust-proofing steel sheet for the fuel tank according to the present invention will be represented by Examples.

(Example 1)

The material of the present invention was produced by degreasing and pickling an annealed low carbon steel, then effecting Ni pre-plating and Fe—Ni pre-plating or continuous hot-dip plating by a flux method without effecting pre-plating to adjust the plating quantity and further cooling the material. Table 1 tabulates the inner and outer surface corrosion resistances of the resulting materials of this invention and their solderability.

(1) Inner surface corrosion resistance

The inner surface corrosion resistance was evaluated by using the samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(Inner surface evaluation method)

Cup draw forming was conducted, and a test was carried out for one month at 45° C. by charging fuel into the cup. The appearance of the inner surface of the sample and the corrosion state of the base were evaluated.

Cup drawing conditions: punch diameter 30 mmϕ, blank diameter 60 mmϕ, drawing depth 15 mm.

Corrosion test solution: deteriorated gasoline, 100× diluted solution 4.5 cc+distilled water 0.5 cc.

(2) Outer surface corrosion resistance

The outer surface corrosion resistance was evaluated by using the samples having the following shapes and the following test conditions. As a result, the materials of the present invention were found excellent, with no corrosion from the base. On the other hand, red rust and red change occurred from the base and remarkable discoloration occurred due to the influence of the melting of the plating layer in the comparative materials, and their corrosion resistance was not excellent.

(Outer surface evaluation method)

Cup draw forming was conducted, and each sample was placed horizontally so that brine could be sprayed onto the outer surface. The appearance and the corrosion state of the base one month after the spraying were evaluated.

Cup drawing conditions: punch diameter 30 mmϕ, blank diameter 60 mmϕ, drawing depth 15 mm.

Brine spray conditions: 5% sodium chloride solution, 50° C.

(3) Solderability

Solder spreadability was evaluated under the following test conditions. As a result, the materials of the present invention exhibited results equivalent or superior to those of existing Pb—Sn plated steel sheets. On the other hand, solderability of the comparative materials was not good because they were samples having high zinc contents.

(Solderability evaluation method)

Each flat sheet sample was degreased with toluene. After a small amount of a flux was applied, a predetermined quantity of solder was applied. Thereafter, each sample was floated in a lead bath for a predetermined time, and was then pulled out so as to measure the solder spreading area.

Test condition: solder/Pb—40% Sn (250 mg), flux/13% rosin—isopropyl alcohol, lead bath/sample was floated at 280° C. for 30 seconds and was then pulled up.

(Example 2)

The materials of the present invention were produced by degreasing and pickling an annealed low carbon steel, then effecting nickel pre-plating or Fe—Ni pre-plating or continuous hot-dip plating by a flux method without effecting pre-plating to adjust the plating quantity, further cooling the materials and thereafter conducting chromate treatment. Table 2 tabulates the inner and outer surface corrosion resistances of the resulting materials of this invention and their solderability (each test condition being the same as that of Example 1).

(1) Inner surface corrosion resistance

The inner surface corrosion resistance was evaluated by using samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influences of the melting of the plating layer.

(2) Outer surface corrosion resistance

The outer surface corrosion resistance was evaluated by using samples having the following shapes and the following test conditions. As a result, the materials of the present invention were found excellent, with no corrosion from the base. On the other hand, red rust and red change occurred from the base and remarkable discoloration occurred due to the influence of the melting of the plating layer in the comparative materials, and their corrosion resistance was not excellent.

(3) Solderability

Solder spreadability was evaluated under the following test conditions. As a result, the materials of the present invention exhibited results equivalent or superior to those of existing Pb—Sn plated steel sheets. On the other hand, the solderability of the comparative materials was not good because of their large zinc film contents.

TABLE 1

| Section | No. | Pre-plating q'ty ($g/m^2$)*1 | Thickness of alloy layer (μm) | Sn content in plating layer (wt %) | No. of coarse Zn crystals in plating layer (crystals/0.25 $mm^2$)*2 | Thickness of plating layer (μm) | Performance evaluation result: Inner surface corrosion resistance*3 | Outer surface corrosion resistance*3 | Solder-ability*4 |
|---|---|---|---|---|---|---|---|---|---|
| This Invention | 1 | Ni/0.2 | 2.00 | 99 | 0 | 49 | ◎ | ◎ | ◎ |
| | 2 | Ni/2.9 | 0.35 | 90 | 0 | 43 | ◎ | ◎ | ◎ |
| | 3 | Fe—Ni/0.3 | 0.90 | 99 | 0 | 48 | ◎ | ◎ | ◎ |
| | 4 | Fe—Ni/2.8 | 0.95 | 41 | 20 | 7.0 | ◎ | ◎ | ◎ |
| | 5 | nil | 0.35 | 41 | 17 | 4.3 | ◎ | ◎ | ◎ |
| Comparative Materials | 6 | Ni/1.1 | 0.55 | 46 | 36 | 8.8 | x | Δ | ◎ |
| | 7 | nil | 2.45 | 41 | 16 | 3.8 | x | x | ◎ |

*1Ni content ($g/m^2$) in Ni or Fe—Ni plating

*2Number of zinc crystals having major diameter of at least 250 μm in plating layer per 0.25 $mm^2$ surface area

*3Evaluation result:

◎ . . . no large change in appearance

Δ . . . large change in appearance, x . . . rust from base

*4In comparison with 8% Sn plated steel sheet,

◎ . . . equivalent or greater spreading area

Δ . . . 50 to 80% spreading area x . . . less than 50% spreading area

TABLE 2

| Section | No. | Pre-plating q'ty ($g/m^2$)*1 | Thickness of alloy layer (μm) | Sn content in plating layer (wt %) | No. of coarse Zn crystals in plating layer (crystals/ 0.25 $mm^2$)*2 | Thickness of plating layer (μm) | Cr conversion q'ty ($mg/mm^2$) | Performance evaluation result: Inner surface corrosion resistance*3 | Outer surface corrosion resistance*3 | Solder-ability*4 |
|---|---|---|---|---|---|---|---|---|---|---|
| This Invention | 1 | Ni/0.2 | 0.30 | 80 | 1 | 4.1 | 10.0 | ◎ | ◎ | ◎ |
| | 2 | Ni/3.0 | 0.65 | 99 | 0 | 46 | 24.8 | ◎ | ◎ | ◎ |
| | 3 | Ni/2.9 | 0.95 | 41 | 0 | 49 | 0.2 | ◎ | ◎ | ◎ |
| | 4 | Fe—Ni/3.0 | 1.00 | 98 | 0 | 49 | 10.5 | ◎ | ◎ | ◎ |
| | 5 | nil | 0.30 | 99 | 0 | 4.3 | 0.4 | ◎ | ◎ | ◎ |
| Comparative Materials | 6 | Ni/1.1 | 0.55 | 46 | 43 | 8.8 | 0.1 | x | Δ | x |
| | 7 | nil | 0.60 | 99 | 0 | 1.8 | 10.2 | x | x | Δ |

*1Ni content ($g/m^2$) in Ni or Fe—Ni plating
*2No. of zinc crystals having major diameter of at least 250 μm in plating layer per 0.25 $mm^2$ surface area
*3Performance result:
◎ . . . no large change in appearance
Δ . . . large change in appearance
x . . . rust from base
*4In comparison with 8% Sn plated steel sheet:
◎ . . . equivalent or greater spreading area
Δ . . . 50 to 80% spreading area
x . . . less than 50% spreading area (Example 3)

The materials of the present invention were producing by degreasing and pickling pickled hot-rolled sheets or cold-rolled sheets and then effecting Ni pre-plating or Fe—Ni pre-plating, or by heat-treating pickled hot-rolled sheets or cold-rolled sheets as such inside a furnace having a non-oxidizing furnace, a reducing furnace, etc., and thereafter carrying out hot-dip plating, adjusting a plating quantity, and cooling.

Table 3 tabulates the inner and outer surface corrosion resistance and solderability of the resulting materials of the present invention (with each test condition being the same as that of Example 1).

(1) Inner surface corrosion resistance

The inner surface corrosion resistance was evaluated by using the samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(2) Outer surface corrosion resistance

The outer surface corrosion resistance was evaluated by using the samples having the following shapes and the following test conditions. As a result, the materials of the present invention were found excellent, with no corrosion from the base. On the other hand, red rust and red change occurred from the base and remarkable discoloration occurred due to the influence of the melting of the plating layer in the comparative materials, and their corrosion resistance was not excellent.

(3) Solderability

Solder spreadability was evaluated under the following test conditions. As a result, the materials of the present invention exhibited results equivalent or superior to those of existing Pb—Sn plated steel sheets. On the other hand, solderability of the comparative materials was not good because of their large zinc contents.

TABLE 3

| Section | No. | Pre-plating q'ty ($g/m^2$)*1 | Thickness of alloy layer (μm) | Sn content in plating layer (wt %) | No. of coarse Zn crystals in plating layer (crystals/ 0.25 $mm^2$)*2 | Thickness of plating layer (μm) | Performance evaluation result: Inner surface corrosion resistance*3 | Outer surface corrosion resistance*3 | Solder-ability*4 |
|---|---|---|---|---|---|---|---|---|---|
| This Invention | 1 | Ni/0.2 | 0.40 | 99 | 0 | 2.3 | ◎ | ◎ | ◎ |
| | 2 | Ni/2.9 | 1.90 | 41 | 20 | 49 | ◎ | ◎ | ◎ |
| | 3 | Fe—Ni/2.9 | 1.95 | 99 | 0 | 48 | ◎ | ◎ | ◎ |
| | 4 | nil | 1.35 | 98 | 1 | 4.1 | ◎ | ◎ | ◎ |

TABLE 3-continued

| Section | No. | Pre-plating q'ty ($g/m^2$)*1 | Thickness of alloy layer ($\mu m$) | Sn content in plating layer (wt %) | No. of coarse Zn crystals in plating layer (crystals/ 0.25 $mm^2$)*2 | Thickness of plating layer ($\mu m$) | Performance evaluation result: Inner surface corrosion resistance*3 | Outer surface corrosion resistance*3 | Solder-ability*4 |
|---|---|---|---|---|---|---|---|---|---|
| Comparative | 6 | Ni/0.1 | 0.50 | 35 | 28 | 3.3 | x | x | Δ |
| Materials | 7 | nil | 2.30 | 41 | 0 | 4.8 | x | Δ | ⊙ |

*1Ni content in Ni or Fe—Ni plating
*2Number of zinc crystals having major diameter of at least 250 $\mu m$ per 0.25 $mm^2$ surface area in plating layer
*3Performance evaluation result:
⊙: no large change in appearance
Δ: large change in appearance
x: rust from base
*4In comparison with Pb—8% Sn plated steel sheet:
⊙: equivalent or greater spreading area
Δ: 50 to 80% spreading area
x: less than 50% spreading area (Example 4)

The materials of the present invention were produced by degreasing and pickling pickled hot-rolled sheets or cold-rolled sheets and then effecting Ni pre-plating or Fe—Ni pre-plating, or by heat-treating pickled hot-rolled sheets or cold-rolled sheets as such inside a furnace having a non-oxidizing furnace, a reducing furnace, etc., and thereafter carrying out hot-dip plating, adjusting the plating quantity, and cooling.

Table 4 tabulates the inner and outer surface corrosion resistance and solderability of the resulting materials of the present invention.

(1) Inner surface corrosion resistance

The inner surface corrosion resistance was evaluated by using samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(2) Outer surface corrosion resistance

The outer surface corrosion resistance was evaluated by using samples having the following shapes and the following test conditions. As a result, the materials of the present invention were found excellent, with no corrosion from the base. On the other hand, red rust and red change occurred from the base and remarkable discoloration occurred due to the influence of the melting of the plating layer in the comparative materials, and their corrosion resistance was not excellent.

(3) Solderability

Solder spreadability was evaluated under the following test conditions. As a result, the materials of the present invention exhibited results equivalent or superior to those of existing Pb—Sn plated steel sheets. On the other hand, the solderility of the comparative materials was not good of their large chromate film contents.

TABLE 4

| Section | No. | Pre-plating q'ty ($g/m^2$)*1 | Thickness of alloy layer ($\mu m$) | Sn content in plating layer (wt %) | No. of coarse Zn crystals in plating layer (crystals/ 0.25 $mm^2$)*2 | Thickness of plating layer ($\mu m$) | Cr conversion q'ty ($mg/mm^2$) | Performance evaluation result: Inner surface corrosion resistance*3 | Outer surface corrosion resistance*3 | Solder-ability*4 |
|---|---|---|---|---|---|---|---|---|---|---|
| This | 1 | Ni/2.9 | 0.35 | 98 | 0 | 48 | 24.8 | ⊙ | ⊙ | ⊙ |
| Invention | 2 | Fe—Ni/0.2 | 2.00 | 41 | 11 | 48 | 24.6 | ⊙ | ⊙ | ⊙ |
| | 3 | nil | 1.50 | 41 | 20 | 8.8 | 10.5 | ⊙ | ⊙ | ⊙ |
| | 4 | nil | 0.55 | 80 | 0 | 2.6 | 0.3 | ⊙ | ⊙ | ⊙ |
| Comparative | 5 | Ni/0.3 | 2.30 | 41 | 25 | 3.7 | 0.1 | x | x | x |
| Materials | 6 | Fe—Ni/2.9 | 1.00 | 42 | 37 | 4.2 | 0.1 | x | x | x |

*1Ni content in Ni or Fe—Ni plating layer ($g/m^2$)
*2Number of zinc crystals having major diameter of at least 250 $\mu m$ per 0.25 $mm^2$ surface layer in plating layer
*3Performance evaluation result:
⊙: no great change in appearance
Δ: great change in appearance
x: rust from base
*4In comparison with Pb—8% Sn plated steel sheet:
⊙: equivalent or greater spreading area
Δ: 50 to 80% spreading area
x: less than 50% spreading area (Example 5)

The materials of the present invention were produced by degreasing and pickling an annealed low carbon steel, then effecting Ni pre-plating and Fe—Ni pre-plating or continuous hot-dip plating by a flux method without effecting pre-plating, variously adjusting the line speed and flux conditions, further adjusting the plating quantity, and cooling the materials. Furthermore, the surface coarseness of the materials was adjusted by the roll coarseness at the time of skin pass rolling and the reduction force. Table 5 tabulates formability of the resulting materials of the present invention and their inner surface corrosion resistance.

(1) Formability

Press forming was carried out under the following test conditions, and formability and adhesion of plating after forming were evaluated. As a result, the materials of the present invention exhibited results equivalent or superior to those of existing Pb—Sn plated steel sheets. On the other hand, cracks and peel of plating occurred in the comparative materials depending on the formability and lubricating property of the alloy layer and the plating layer.

After a rust-proofing oil was applied to the flat sheet sample, crank pressing was carried out by changing the forming depth, and the maximum forming depth at which forming could be made and did not lead to peeling of the plating was determined.

Test conditions:

Die shoulder radius/3.5 mm, die corner radius/10 mm, punch shoulder radius/3 mm, punch size/70×70 mm, press force 110 tons.

Plating peel evaluation:

Both the outside and inside of a corner side wall after forming were carefully taped, and the existence of peeling of the plating, if any, was inspected by eye.

Judgement method:

Evaluation was according to the depth at which forming was possible without peeling of the plating.

⊙: greater than 30 mm,

Δ: less than 30 mm to greater than 25 mm,

×: less than 25 mm (2) Inner surface corrosion resistance of formed materials

The inner surface corrosion resistance was evaluated by using samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(Method of evaluating inner surface corrosion resistance)

Cup draw forming was conducted, and a test was carried out for one month at 45° C. by charging fuel into, the cup. Appearance of the inner surface wall of the samples and the corrosion state of the base were evaluated. However, a rust-proofing oil was used at the time of drawing the cup, and degreasing was sufficiently carried out with toluene before the corrosion resistance test.

Cut drawing conditions:

Punch diameter 28.5 mmϕ, blank diameter 60 mmϕ, drawing depth 22 mm.

Corrosion test solution: 10× diluted solution of deteriorated gasoline 6.3 cc+distilled water 0.7 cc.

Judgement method:

⊙: no remarkable change in appearance

Δ: remarkable change in appearance

×: rust from the base

TABLE 5

| Section | No. | Pre-plating q'ty ($g/m^2$)*1 | Thickness of alloy layer (μm) | Thickness of plating layer (μm) | No. of coarse Zn crystals in plating layer (crystals/ 0.25 $mm^2$)*2 | Coarseness Ra | Coating oil q'ty | Performance evaluation result: Formability | Performance evaluation result: Inner surface corrosion resistance of machine material |
|---|---|---|---|---|---|---|---|---|---|
| This Invention | 1 | Ni/0.1 | 0.55 | 2.2 | 0 | 0.2 | small | ⊙ | ⊙ |
| | 2 | Ni—Fe/2.3 | 1.35 | 2.8 | 2 | 0.5 | great | ⊙ | ⊙ |
| | 3 | nil | 0.40 | 24.5 | 18 | 3.0 | small | ⊙ | ⊙ |
| | 4 | nil | 0.95 | 22.5 | 0 | 0.2 | great | ⊙ | ⊙ |
| Comparative Materials | 5 | Ni/2.4 | 1.80 | 35.0 | 2 | 0.1 | small | x | x |
| | 6 | Fe—Ni/1.0 | 1.00 | 19.5 | 21 | 0.1 | great | x | x |

*1Ni content in Ni or Fe—Ni plating ($g/m^2$)

*2Number of zinc crystals having major diameter of at least 250 μm per 0.25 $mm^2$ in plating layer (Example 6)

The materials of the present invention were produced by degreasing and pickling pickled hot-rolled sheets or cold-rolled sheets and then effecting Ni pre-plating or Fe—Ni pre-plating, or by heat-treating pickled hot-rolled sheets or cold-rolled sheets as such inside a furnace having a non-oxidizing furnace, a reducing furnace, etc., carrying out thereafter hot-dip plating, adjusting the plating quantity, further cooling the materials, adjusting the surface coarseness by the roll coarseness and a reduction ratio at the time of pressure governing, and further carrying out chromate treatment. Table 6 tabulates the formability characteristics of the resulting materials of the present invention and their inner surface corrosion resistance. Each test condition was the same as that of Example 5.

(1) Formability

Press forming was carried out under the following test conditions, and formability and adhesion of plating after forming were evaluated. As a result, the materials of the present invention exhibited results equivalent or superior to those of existing lead-tin plated steel sheets. On the other hand, cracks and peeling of the plating occurred in the comparative materials depending on formability and lubricating property of the alloy layer and the plating layer.

(2) Inner corrosion resistance of formed materials

The inner surface corrosion resistance was evaluated by using samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(Outer surface evaluation method)

Cup draw forming was conducted, and each sample was placed horizontally so that brine could be sprayed onto the outer surface. The appearance and the corrosion state of the base one month after the spraying were evaluated.

TABLE 6

| Section | No. | Pre-plating q'ty ($g/m^2$)*1 | Thickness of alloy layer ($\mu m$) | Thickness of plating layer ($\mu m$) | No. of coarse Zn crystals in plating layer (crystals/0.25 $mm^2$)*2 | Coarseness Ra | Cr conversion q'ty ($mg/m^2$) | Coating oil q'ty | Performance evaluation result: Formability | Performance evaluation result: Inner surface corrosion resistance of machine material |
|---|---|---|---|---|---|---|---|---|---|---|
| This Invention | 1 | Ni/0.1 | 0.75 | 3.1 | 1 | 0.2 | 24.8 | small | ◎ | ◎ |
| | 2 | Ni—Fe/2.3 | 0.95 | 5.5 | 0 | 3.0 | 24.6 | great | ◎ | ◎ |
| | 3 | | 1.40 | 2.1 | 0 | 0.3 | 10.5 | small | ◎ | ◎ |
| | 4 | | 1.45 | 4.9 | 20 | 0.4 | 0.3 | great | ◎ | ◎ |
| Comparative Materials | 5 | Ni/2.4 | 0.55 | 35.0 | 19 | 0.1 | 0.1 | small | x | x |
| | 6 | Fe—Ni/1.0 | 1.95 | 2.3 | 38 | 0.1 | 0.1 | great | x | x |

*1Ni content in Ni or Fe—Ni plating ($g/m^3$)
*2Number of zinc crystals per 0.25 $mm^2$ surface area in plating layer (Example 7)

The materials of the present invention were produced by degreasing and pickling the annealed steels shown in Table 7, effecting Ni plating or Fe—Ni plating, or continuous hot-dip plating by a flux method without effecting pre-plating, adjusting the plating quantity, and cooling the materials. Chromate treatment was applied to a part of the materials.

Table 7 tabulates the inner corrosion resistance, the outer surface corrosion resistance, solderability and formability of the resulting materials of the present invention.

(1) Inner surface corrosion resistance

The inner surface corrosion resistance was evaluated by using the samples having the following shapes and the following test condition. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(Inner surface evaluation method)

Cup draw forming was conducted, and a test was carried out for one month at 45° C. by charging fuel into the cup. The appearance of the inner surface of the samples and the corrosion state of the base were evaluated.

Cup drawing conditions:

Punch diameter 28.5 mmϕ, blank diameter 60 mmϕ, drawing depth 18 mm.

Corrosion test solution: 100× diluted solution of deteriorated gasoline 4.5 cc+distilled water 0.5 cc.

(2) Outer surface corrosion resistance

The outer surface corrosion resistance was evaluated by using the samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

Cup drawing conditions:

Punch diameter 28.5 mmϕ, blank diameter 60 mmϕ, drawing depth 18 mm.

Brine spray conditions: 5% sodium chloride solution, 50° C.

(3) Solderability

Solder spreadability was evaluated under the following test conditions. As a result, the materials of the present invention exhibited results equivalent or superior to those of existing Pb—Sn steel sheets. On the other hand, solderability of the comparative materials was not good because of their large zinc contents.

(Method of evaluating solderability)

Each flat sheet sample was degreased with toluene. After a small amount of a flux was applied, a predetermined quantity of solder was applied. Thereafter, each sample was floated in a lead bath for a predetermined time, and was then pulled out so as to measure the solder spreading area.

Test conditions:

Solder/lead—40% tin (250 mg), flux/13% rosin—isopropyl alcohol, lead bath/sample was floated at 280° C. for 30 seconds and was then removed.

(4) Press formability

Press forming was carried out under the following test conditions, and press formability and adhesion of plating after forming were evaluated. As a result, the materials of the present invention exhibited good results equivalent or superior to those of existing Pb—Sn plated steel sheets. On the other hand, cracks and peeling of the plating occurred in the comparative materials depending on the steel component system, the alloy layer, the thickness of the plating layer and the plating composition.

(Press formability)

After lubricating oil was applied to each flat sheet sample, drawing was carried out by variously changing blank diameters, and a maximum diameter at which drawing could be made and peeling of the plating did not occur were determined.

Test conditions:

Press conditions: Punch diameter 25 mm, crease push force 500 kg.

Peeling of the plating: The outer wall of the side surface after forming was taped, and peeling of the plating, if any, was inspected by eye.

TABLE 7

| Section | No. | Component composition of steel (wt %) C | Si | Mn | P | S | Ti | Al | Nb | B | N |
|---|---|---|---|---|---|---|---|---|---|---|---|
| This Invention | 1 | 0.035 | 0.025 | 0.11 | 0.033 | 0.015 | — | 0.035 | — | 0.0026 | 0.0040 |
| | 2 | 0.078 | 0.029 | 1.03 | 0.025 | 0.025 | — | 0.080 | — | — | 0.0059 |
| | 3 | 0.054 | 0.098 | 0.27 | 0.017 | 0.017 | — | 0.063 | — | — | 0.0053 |
| | 3 | 0.054 | 0.098 | 0.27 | 0.017 | 0.017 | — | 0.063 | — | — | 0.0053 |
| | 4 | 0.004 | 0.030 | 0.21 | 0.032 | 0.032 | 0.085 | 0.038 | — | 0.0008 | 0.0053 |
| | 5 | 0.003 | 0.054 | 1.16 | 0.013 | 0.013 | — | 0.093 | 0.044 | 0.0003 | 0.0038 |
| | 6 | 0.004 | 0.015 | 0.19 | 0.018 | 0.018 | 0.015 | 0.048 | 0.014 | — | 0.0023 |
| Comparative Materials | 7 | 0.019 | 0.023 | 0.56 | 0.025 | 0.025 | — | 0.078 | — | — | — |
| | 8 | 0.032 | 0.058 | 0.96 | 0.024 | 0.024 | 0.095 | 0.034 | — | — | — |
| | 9 | 0.004 | 0.024 | 2.15 | 0.025 | 0.025 | 0.072 | 0.092 | 0.036 | — | 0.0039 |

| Section | No. | Pre-plating q'ty ($g/m^2$)*1 | Thickness of alloy layer ($\mu m$) | Sn content in plating layer (wt %) | No. of coarse Zn crystals in plating layer (crystals/0.25 $mm^2$)*2 | Thickness of plating layer ($\mu m$) | Cr conversion q'ty ($mg/m^2$) | Inner surface corrosion resistance*3 | Outer surface corrosion resistance*3 | Solderability*4 | Press formability*5 |
|---|---|---|---|---|---|---|---|---|---|---|---|
| This Invention | 1 | Ni/0.1 | 0.55 | 98 | 0 | 50 | — | ◎ | ◎ | ◎ | ◎ |
| | 2 | Fe—Ni/2.9 | 1.00 | 99 | 0 | 4.5 | — | ◎ | ◎ | ◎ | ◎ |
| | 3 | Fe—Ni/1.0 | 1.50 | 71 | 20 | 4.1 | — | ◎ | ◎ | ◎ | ◎ |
| | 3 | nil | 0.80 | 72 | 3 | 49 | — | ◎ | ◎ | ◎ | ◎ |
| | 4 | Ni/2.9 | 0.90 | 81 | 15 | 50 | 9.0 | ◎ | ◎ | ◎ | ◎ |
| | 5 | Fe—Ni/0.1 | 1.00 | 72 | 4 | 48 | — | ◎ | ◎ | ◎ | ◎ |
| | 6 | nil | 1.45 | 70 | 2 | 48 | — | ◎ | ◎ | ◎ | ◎ |
| Comparative Materials | 7 | Ni/0.1 | 0.95 | 98 | 0 | 3.2 | — | x | x | Δ | x |
| | 8 | Fe—Ni/2.9 | 0.30 | 60 | 31 | 48 | — | Δ | Δ | ◎ | x |
| | 9 | nil | 1.00 | 32 | 5 | 3.8 | 0.9 | x | Δ | x | x |

*1Ni content in Ni or Fe—Ni plating ($g/m^2$)
*2Number of zinc crystals having major diameter of at least 250 $\mu m$ per 0.25 $mm^2$ in plating layer
*3Performance evaluation result:
◎: no large change in appearance
Δ: large change in appearance
x: rust from base
*4In comparison with Pb—8% Sn plated steel sheet:
◎: equivalent or greater spreading area
Δ: 50 to 80% spreading area
x: less than 50% spreading area
*5Performance evaluation (maximum drawing ratio at which drawing was possible without peeling of the plating:
◎: at least 2.3
Δ: less than 2.3 to greater than 2.15
x: less than 2.15

(Example 8)

The materials of the present invention were produced by degreasing and pickling the annealed steel sheets shown in Table 8, effecting Ni plating or Fe—Ni plating, or continuous hot-dip plating by a flux method without effecting pre-plating, adjusting the plating quantity, and cooling the materials. Chromate treatment was applied to a part of the materials.

Table 8 tabulates the inner surface corrosion resistance, the outer surface corrosion resistance, solderability and press formability of the resulting materials of the present invention (with the test conditions being the same as those of Example 7).

(1) Inner surface corrosion resistance

The inner surface corrosion resistance was evaluated by using the samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(2) Outer surface corrosion resistance

The outer surface corrosion resistance was evaluated by using samples having the following shapes and the following test conditions. As a result, the materials of the present invention were found excellent, with no corrosion from the base. On the other hand, red rust and red change occurred from the base and remarkable discoloration occurred due to the influence of the melting of the plating layer in the comparative materials, and their corrosion resistance was not excellent.

(3) Solderability

Solder spreadability was evaluated under the following test conditions. As a result, the materials of the present invention exhibited results equivalent or superior to those of existing Pb—Sn plated steel sheets. On the other hand, the solderability of the comparative materials was not good because of their large zinc contents.

(4) Press formability

Press forming was carried out under the following conditions, and press formability and adhesion of plating after forming were evaluated. As a result, the materials of the present invention exhibited the excel-lent result equivalent or superior to existing Pb—Sn plated steel sheets.

On the other hand, cracks and peeling of the plating occurred in the comparative materials depending on the steel component systems, the alloy layers, the thickness of the plating layer and the plating compositions.

TABLE 8

| Section | No. | Component composition of steel (wt %) C | Si | Mn | P | S | Ti | Al | Nb | B | N |
|---|---|---|---|---|---|---|---|---|---|---|---|
| This Invention | 1 | 0.054 | 0.095 | 0.78 | 0.020 | 0.014 | — | 0.029 | — | — | 0.0039 |
| | 2 | 0.099 | 0.013 | 0.26 | 0.037 | 0.019 | — | 0.067 | — | 0.0027 | 0.0054 |
| | 3 | 0.003 | 0.014 | 0.21 | 1.18 | 0.015 | 0.025 | 0.069 | — | 0.0009 | 0.0033 |
| | 4 | 0.002 | 0.046 | 0.15 | 0.030 | 0.017 | 0.075 | 0.032 | 0.044 | 0.0003 | 0.0019 |
| | 5 | 0.006 | 0.033 | 0.21 | 0.018 | 0.019 | 0.029 | 0.089 | 0.032 | — | 0.0035 |
| Comparative Materials | 6 | 0.019 | 0.033 | 0.65 | 0.021 | 0.019 | 0.015 | 0.078 | — | — | — |
| | 7 | 0.003 | 0.078 | 1.25 | 0.025 | 0.019 | 0.037 | 0.077 | 0.023 | — | 0.0046 |

| Section | No. | Pre-plating q'ty ($g/m^2$)*1 | Thickness of alloy layer (μm) | Sn content in plating layer (wt %) | No. of coarse Zn crystals in plating layer (crystals/ 0.25 $mm^2$)*2 | Thickness of plating layer (μm) | Cr conversion q'ty ($mg/m^2$) | Inner surface corrosion resistance*3 | Outer surface corrosion resistance*3 | Solderability*4 | Press formability*5 |
|---|---|---|---|---|---|---|---|---|---|---|---|
| This Invention | 1 | nil | 1.25 | 98 | 0 | 49 | — | ⊙ | ⊙ | ⊙ | ⊙ |
| | 2 | Ni/2.8 | 0.85 | 99 | 0 | 47 | — | ⊙ | ⊙ | ⊙ | ⊙ |
| | 3 | Fe—Ni/2.9 | 1.50 | 70 | 4 | 7.9 | — | ⊙ | ⊙ | ⊙ | ⊙ |
| | 4 | nil | 1.40 | 99 | 0 | 4.2 | 25.0 | ⊙ | ⊙ | ⊙ | ⊙ |
| | 5 | Ni/2.9 | 0.55 | 99 | 9 | 7.7 | 0.2 | ⊙ | ⊙ | ⊙ | ⊙ |
| Comparative Materials | 6 | Ni/2.9 | 1.25 | 38 | 36 | 4.2 | — | x | x | x | x |
| | 7 | nil | 2.90 | 28 | 45 | 3.8 | 15.3 | x | x | x | x |

*1Ni content in Ni or Fe—Ni plating ($g/m^2$)

*2Number of zinc crystals having major diameter of at least 250 μm per 0.25 $mm^2$ surface in plating layer

*3 Performance evaluation result:

⊙: no large change in appearance

Δ: large change in appearance x: rust from base

*4In comparison with Pb—8% Sn plated steel sheet:

⊙: equivalent or greater spreading area

Δ: 50 to 80% spreading area x: less than 50% spreading area

*5Performance evaluation (maximum drawing ratio at which drawing was possible without peeling of the plating)

⊙: at least 2.3

Δ: less than 2.3 to at least 2.15 x: less than 2.15

(Example 9)

The materials of the present invention were produced by degreasing and pickling the annealed steels tabulated in Table 9, effecting Ni pre-plating and Fe—Ni pre-plating, or continuous hot-dip plating by a flux method without effecting pre-plating, adjusting a plating amount and further cooling the materials. Incidentally, chromate treatment was applied to a part of the materials.

Table 9 tabulates the inner surface corrosion resistance, the outer surface corrosion resistance, solderability and formability of the resulting materials of the present invention.

(1) Inner surface corrosion resistance

The inner surface corrosion resistance was evaluated by using the samples having the following shapes and the following test conditions. As a result, the materials of the present invention were found excellent, with no corrosion from the base. On the other hand, the corrosion resistance of many comparative materials was not excellent because red rust and red change occurred from the base and remarkable discoloration occurred due to the influence of the melting of the plating layer.

(Inner surface evaluation method)

Cup draw forming was conducted, and a test was carried out for one month at 45° C. by charging fuel into the cup. The appearance of the inner surface of the samples and the corrosion state of the base were evaluated.

Cup drawing conditions:

Punch diameter 28.5 mmϕ, blank diameter 60 mmϕ, drawing depth 18 mm.

Corrosion test solution: 100× diluted solution of deteriorated gasoline 4.5 cc+distilled water 0.5 cc.

(2) Outer surface corrosion resistance

The outer surface corrosion resistance was evaluated by using samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(Outer surface evaluation method)

Cup draw forming was conducted, and each sample was placed horizontally so that brine could be sprayed onto the outer surface. The appearance and the corrosion state of the base one month after the spraying were evaluated.

Cup drawing conditions:

Punch diameter 285 mmϕ, blank diameter 60 mmϕ, drawing depth 18 mm.

Brine spray conditions: 5% sodium chloride solution, 50° C.

(3) Solderability

Solder spreadability was evaluated under the following test conditions. As a result, the materials of the present invention exhibited results equivalent or superior to those of existing Pb—Sn steel sheets. On the other hand, the solderability of the comparative materials was not good because of their large zinc contents.

(4) Press formability

Press forming was carried out under the following test conditions, and press formability and adhesion of plating after forming were evaluated. As a result, the materials of the present invention exhibited good results equivalent or superior to those of existing Pb—Sn plated steel sheets. On the other hand, cracking and peeling of plating occurred in the comparative materials depending on the steel component system, the alloy layer, the thickness of the plating layer and the plating composition.

(Press formability)

After lubricating oil was applied to each flat sheet sample, drawing was carried out by variously changing blank diameters, and the maximum diameter at which drawing could be carried out and peeling of the plating did not occur were determined.

Test conditions:

Press conditions: Punch diameter 25 mm, crease push force 500 kg.

Peeling of the plating: Outer wall of the side surface after machining was taped, and peeling of the plating, if any, was inspected by eye.

TABLE 9

| Section | No. | Component composition of steel (wt %) C | Si | Mn | P | S | Ti | Al | Nb | B | N | Cr |
|---|---|---|---|---|---|---|---|---|---|---|---|---|
| This Invention | 1 | 0.079 | 0.033 | 1.45 | 0.028 | 0.019 | — | 0.055 | — | 0.0012 | 0.0039 | 1.9 |
| | 2 | 0.062 | 0.036 | 0.58 | 0.034 | 0.032 | — | 0.097 | — | — | 0.0045 | 5.8 |
| | 3 | 0.003 | 0.020 | 0.11 | 0.018 | 0.020 | 0.032 | 0.061 | 0.027 | 0.0003 | 0.0036 | 0.3 |
| | 4 | 0.005 | 0.049 | 1.05 | 0.020 | 0.026 | 0.097 | 0.042 | — | — | 0.0040 | 3.5 |
| | 5 | 0.002 | 0.099 | 0.32 | 0.012 | 0.012 | — | 0.079 | 0.065 | — | 0.0078 | 0.8 |
| Comparative Materials | 6 | 0.033 | 0.075 | 0.78 | 0.021 | 0.034 | — | 0.086 | — | — | 0.0038 | 5.5 |
| | 7 | 0.016 | 0.082 | 0.55 | 0.019 | 0.020 | 0.056 | 0.033 | — | — | 0.0040 | 0.1 |
| | 8 | 0.020 | 1.11 | 1.85 | 0.027 | 0.023 | 0.036 | 0.077 | 0.034 | 0.0005 | 0.0037 | — |

| Section | No. | Pre-plating q'ty ($g/m^2$)*1 | Thickness of alloy layer (μm) | Sn content in plating layer (wt %) | No. of coarse Zn crystal in plating layer (crystals/ 0.25 $mm^2$)*2 | Thickness of plating layer (μm) | Cr conversion q'ty ($mg/m^2$) | Inner surface corrosion resistance*3 | Outer surface corrosion resistance*3 | Solderability*4 | Press formability*5 |
|---|---|---|---|---|---|---|---|---|---|---|---|
| This Invention | 1 | Fe—Ni/3.0 | 1.45 | 99 | 0 | 4.3 | — | ◎ | ◎ | ◎ | ◎ |
| | 2 | Ni/3.0 | 1.50 | 82 | 0 | 48 | — | ◎ | ◎ | ◎ | ◎ |
| | 3 | Fe—Ni/0.2 | 1.45 | 80 | 20 | 50 | — | ◎ | ◎ | ◎ | ◎ |
| | 4 | Ni/0.1 | 1.50 | 98 | 0 | 4.2 | 9.5 | ◎ | ◎ | ◎ | ◎ |
| | 5 | nil | 1.45 | 99 | 0 | 4.0 | 0.2 | ◎ | ◎ | ◎ | ◎ |
| Comparative Materials | 6 | Ni/0.1 | 1.05 | 72 | 33 | 3.2 | — | Δ | Δ | Δ | x |
| | 7 | nil | 1.00 | 98 | 0 | 1.3 | 1.2 | x | x | Δ | x |
| | 8 | Fe—Ni/3.0 | 1.70 | 82 | 0 | 2.0 | 0.1 | Δ | Δ | Δ | x |

*1Ni content in Ni or Fe—Ni plating ($g/m^2$)

*2Number of zinc crystals having major diameter of at least 250 μm per 0.25 $mm^2$ surface area in plating layer

*3performance evaluation result:

◎: no great change in appearance

Δ: great change in appearance x: rust from base

*4In comparison with Pb—8% Sn plated steel sheet:

◎: equivalent or greater spreading area

Δ: 50 to 80% spreading area x: less than 50% spreading area

*5Performance evaluation (maximum drawing ratio at which drawing was possible and peeling of the plating did not occur):

◎: at least 2.3

Δ: less than 2.3 to at least 2.15 x: less than 2.15

(Example 10)

The materials of the present invention were produced by degreasing and pickling the annealed steel sheets shown in Table 10, effecting Ni plating or Fe—Ni plating, or continuous hot-dip plating by a flux method without effecting pre-plating, adjusting the plating quantity, and cooling the materials. Chromate treatment was applied to a part of the materials.

Table 10 tabulates the inner surface corrosion resistance, the outer surface corrosion resistance, solderability and formability of the resulting materials of the present invention (with the test condition being the same as those of Example 9).

(1) Inner surface corrosion resistance

The inner surface corrosion resistance was evaluated by using samples having the following shapes and the following test conditions. As a result, the materials of the present invention were found excellent, with no corrosion from the base. On the other hand, the corrosion resistance of the comparative materials was not excellent because red rust and red change occurred from the base and remarkable discoloration occurred due to the influence of the melting of the plating layer.

(4) Press formability

Press forming was carried out under the following conditions, and press formability and adhesion of plating after forming were evaluated. As a result, the materials of the present invention exhibited the excellent results, equivalent or superior to existing Pb—Sn plated steel sheets. On the other hand, cracking and peeling of the plating occurred in the comparative materials depending on the steel component systems, the alloy layers, the thickness of the plating layer and the plating compositions.

TABLE 10

| | | Component composition of steel (wt %) | | | | | | | | | | |
|---|---|---|---|---|---|---|---|---|---|---|---|---|
| Section | No. | C | Si | Mn | P | S | Ti | Al | Nb | B | N | Cr |
| This Invention | 1 | 0.063 | 0.012 | 0.18 | 0.021 | 0.029 | — | 0.068 | — | — | 0.0041 | 1.5 |
| | 2 | 0.002 | 0.018 | 0.21 | 0.019 | 0.018 | — | 0.045 | — | 0.0005 | 0.0045 | 5.2 |
| | 3 | 0.003 | 0.036 | 1.47 | 0.018 | 0.027 | 0.022 | 0.056 | 0.045 | 0.0018 | 0.0029 | 3.5 |
| | 4 | 0.005 | 0.093 | 0.32 | 0.035 | 0.034 | 0.039 | 0.099 | — | 0.0006 | 0.0036 | 0.3 |
| | 5 | 0.004 | 0.08 | 0.78 | 0.020 | 0.017 | — | 0.038 | 0.025 | 0.0002 | 0.0022 | 1.2 |
| Comparative Materials | 6 | 0.035 | 0.045 | 2.09 | 0.072 | 0.029 | 0.016 | 0.036 | — | 0.0002 | 0.0040 | — |
| | 7 | 0.029 | 0.018 | 0.32 | 0.032 | 0.033 | — | 0.033 | 0.032 | — | 0.0032 | 5.9 |
| | 8 | 0.003 | 0.89 | 0.22 | 0.016 | 0.028 | — | 0.077 | — | — | 0.0039 | — |

| Section | No. | Pre-plating q'ty ($g/m^2$)*1 | Thickness of alloy layer (μm) | Sn content in plating layer (wt %) | No. of coarse Zn crystal in plating layer (crystals/0.25 $mm^2$)*2 | Thickness of plating layer (μm) | Cr conversion q'ty ($mg/m^2$) | Inner surface corrosion resistance*3 | Outer surface corrosion resistance*3 | Solderability*4 | Press formability*5 |
|---|---|---|---|---|---|---|---|---|---|---|---|
| This Invention | 1 | nil | 0.65 | 91 | 0 | 48 | — | ◎ | ◎ | ◎ | ◎ |
| | 2 | Ni/0.3 | 1.45 | 82 | 0 | 43 | — | ◎ | ◎ | ◎ | ◎ |
| | 3 | Fe—Ni/2.9 | 1.50 | 82 | 20 | 49 | — | ◎ | ◎ | ◎ | ◎ |
| | 4 | | 0.95 | 85 | 11 | 49 | 24.6 | ◎ | ◎ | ◎ | ◎ |
| | 5 | Ni/2.9 | 1.45 | 80 | 7 | 4.5 | 0.2 | ◎ | ◎ | ◎ | ◎ |
| Comparative Materials | 6 | Fe—Ni/3.0 | 1.80 | 72 | 2 | 7.2 | — | x | x | ◎ | x |
| | 7 | Ni/2.9 | 1.20 | 71 | 18 | 1.5 | 8.0 | Δ | x | Δ | x |
| | 8 | nil | 3.50 | 29 | 22 | 48 | 0.2 | x | x | x | x |

*1Ni content in Ni or Fe—Ni plating ($g/m^2$)
*2Number of zinc crystals having major diameter of at least 250 μm per 0.25 $mm^2$ surface area in plating layer
*3Performance evaluation result:
◎: no great change in appearance
Δ: great change in appearance
x: rust from base
*4In comparison with Pb—8% Sn plated steel sheet:
◎: equivalent or greater spreading area
Δ: 50 to 80% spreading area
x: less than 50% spreading area
*5Performance evaluation (maximum drawing ratio at which drawing was possible and peeling of the plating did not occur):
◎: at least 2.3
Δ: less than 2.3 to at least 2.15
x: less than 2.15

(2) Outer surface corrosion resistance

The outer surface corrosion resistance was evaluated by using samples having the following shapes and the following test conditions. As a result, the materials of the present invention were found excellent, with no corrosion from the base. On the other hand, red rust and red change occurred from the base and remarkable discoloration occurred due to the influence of the melting of the plating layer in the comparative materials, and their corrosion resistance was not excellent.

(3) Solderability

Solder spreadability was evaluated under the following test conditions. As a result, the materials of the present invention exhibited results equivalent or superior to those of existing lead—tin plated steel sheets. On the other hand, solderability of the comparative materials was not good because of their large zinc contents.

(Example 11)

After a plating flux containing zinc chloride and hydrochloric acid was applied to 0.8 mm-thick steel sheets that were annealed and subjected to skin-pass rolling, each steel sheet was introduced into a tin plating bath (bath temperature 380° C.) containing 8 wt % of zinc. After the plating bath and the surface of the steel sheet were allowed to sufficiently react with each other, the steel sheet was removed from the plating bath, the plating quantity was adjusted by a gas wiping method, and the steel sheet was quickly cooled.

Each steel sheet after plating had a 0.7 μm-thick Fe—Sn type alloy layer and a plating layer having a plating quantity (total plating quantity of Sn+Zn) of 32 $g/m^2$ per surface. Product sheets were produced by applying chromate treatment in a deposition quantity of 15 $mg/m^2$ in terms of chromium to the surface of each steel sheet.

The surface of each plated sheet was gently corroded with 1% hydrochloric acid so as to examine the crystal structure of each plated sheet, and a crystal structure (spangle) that could be recognized by eye appeared. The mean value of the major axis of the crystals was 6.5 mm. After polishing of the section, the distribution state of tin and zinc was analyzed by an EPMA (electron probe micro analyzer). As a result, a uniform distribution state could be confirmed.

A corrosion solution was prepared by adding 10 vol % of water to intentionally degraded gasoline formed by leaving gasoline standing at 100° C. a whole day in a pressure container. When a corrosion test was carried out in this corrosion solution at 45° C. for three weeks, the metal ions eluted were primarily zinc ions, and elution of 2,000 ppm was observed. The corrosion resistance was judged excellent.

(Example 12)

Electroplating was applied in a plating quantity of 0.8 $g/m^2$ to each of 0.8 mm-thick steel sheets that were annealed and subjected to skin-pass rolling. After a plating flux containing zinc chloride and hydrochloric acid was applied, each steel sheet was introduced into a tin plating bath (at 350° C.) containing 15 wt % of zinc. After the plating bath and the surface of each steel sheet were allowed to sufficiently react with each other, the steel sheet was removed from the plating bath, the plating quantity was adjusted by a gas wiping method, and the steel sheet was quickly cooled.

Each steel sheet after plating had a 0.5 $\mu$m-thick Fe—Sn type alloy layer (having a Ni content of 17%) and a plating quantity (total plating quantity of Sn+Zn) of 33 $g/m^2$ (per surface). Product sheets were produced by applying chromate treatment in a deposition quantity of 12 $mg/m^2$ in terms of chromium to the surface of each steel sheet.

The surface of each plated sheet was gently corroded with 1% hydrochloric acid so as to examine the crystal structure of each plated sheet, and a crystal structure that could be recognized by eye appeared. The mean value of the major axes of the crystals was 12.0 mm. After polishing of the section, the distribution state of tin and zinc was analyzed by an EPMA (electron probe microanalyzer). As a result, a considerable amount of needle zinc crystals were observed in comparison with Example 11, but a substantially excellent distribution state could be confirmed.

A corrosion solution was prepared by adding 10 vol % of water to intentionally degraded gasoline formed by leaving it standing at 100° C. for a whole day in a pressure container. When a corrosion test was carried out in this corrosion solution at 45° C. for three weeks, the metal ions eluted were primarily zinc ions, and elution of 3,000 ppm was observed. The corrosion resistance was judged excellent.

Comparative Example 1

Electroplating was applied in a plating quantity of 0.8 $g/m^2$ to each of 0.8 mm-thick steel sheets that were annealed and subjected to skin-pass rolling, in the same way as in Example 2. After a plating flux containing zinc chloride and hydrochloric acid was applied to each steel sheet, the steel sheet was introduced into a tin plating bath (at 350° C.) containing 15% of zinc. After the plating bath and the surface of the steel sheet were allowed to sufficiently react with each other, the steel sheet-was removed from the plating bath, the plating quantity was adjusted by a gas wiping method, and the steel sheet was then cooled gently.

Each steel sheet after plating had a 0.5 $\mu$m-thick alloy layer consisting primarily of $FeSn_2$ and a plating layer having a plating quantity (total plating quantity of Sn+Zn) of 33 $g/m^2$ (per surface). Product sheets were produced by applying chromate treatment in a deposition quantity of 12 $mg/m^2$ in terms of chromium to the surface of each steel sheet.

The surface of each plated sheet was gently corroded with 1% hydrochloric acid so as to examine the crystal structure of each plated sheet. It was found that large crystals grew due to gradual cooling, and the mean value of the sizes of the major axes was 30.0 mm. After polishing of the section, the distribution state of tin and zinc was analyzed by an EPMA (electron probe microanalyzer). As a result, a large number of needle-like macrocrystals of zinc was observed, and the segregation state of tin and zinc was confirmed.

When the corrosion test was carried out in the same way as in Example 12, elution of 5,200 ppm of zinc was observed, and deterioration of the corrosion resistance due to the macrocrystals of zinc was confirmed.

(Example 13)

The plated steel sheets of the Examples of the present invention and of the comparative examples were produced by applying foundation plating shown in Table 11 to 0.8 mm-thick steel sheets that were annealed and subjected to skin-pass rolling, then applying a plating flux containing zinc chloride and hydrochloric acid, and introducing them into a tin base alloy plating bath shown in Table 11. After the plating bath and the surface of each steel sheet were allowed to sufficiently react with each other, the steel sheet was removed, the plating quantity was adjusted by a gas wiping method, and each steel sheet was quickly cooled. Incidentally, the thickness of the alloy layer was adjusted by the reaction time between the plating bath and the surface of the steel sheet. After plating, an organic-inorganic composite film was deposited under the conditions shown in Table 11.

As a result, the alloy layer, the plating layer and the organic-inorganic composite film shown in Table 12 were formed. The alloy layer was comprised primarily of iron and tin.

A corrosion solution was prepared by adding 10 vol % of water to intentionally degraded gasoline formed by leaving it standing at 100° C. for a whole day in a pressure container, and each of the steel sheets obtained in the way described above was immersed into this corrosion solution at 45° C. for three weeks for the purpose of the corrosion test. As a result, elution of the metallic ions shown in Table 13 was obtained. The elution quantity of the metallic ions in the present invention was small and excellent. Press formability and bondability were evaluated by producing actually tanks, and the results shown in Table 13 could be obtained. Here, press formability was evaluated by press forming.

A cylinder deep drawing test was carried out as an evaluation method of press forming. Each blank having a diameter of 200 mmϕ was contracted by a punch of 100 mmϕ, and the plating peel state on the cup side wall was inspected. To strictly judge press formability, the shoulder radius of a die was set to 2.5 mm, more severe forming conditions than ordinary forming conditions were employed.

TABLE 11

Plating Conditions and Organic-Inorganic Composite Film Treating Solution Conditions

| No. | Foundation plating | Hot-dip plating | Inorganic-organic composite film treating solution |
|---|---|---|---|
| A | no foundation plating | Sn plating bath containing Zn 8% and balance of Sn and unavoidable impurities, at 300° C. | aqueous solution containing acrylic resin 5 g/l, chromic acid 20 g/l, silica 10 g/l, organic phosphoric acid 3 g/l |
| B | electroplating of Ni in deposition q'ty of 0.8 g/m$^2$ | Sn plating bath containing Zn 12% and balance of Sn, Mg 1% and unavoidable impurities, at 320° C. | aqueous solution containing acryl-modified epoxy resin 20 g/l, barium chromate 10 g/l and silica 10 g/l |
| C | electroplating of Ni in deposition q'ty of 1.5 g/m$^2$ | Sn plating bath containing Zn 9.2%, Al 1.2% and balance of Sn and unavoidable impurities, at 280° C. | aqueous solution containing polyester resin 20 g/l, silica 5 g/l and potassium permanaganate 5 g/l |

TABLE 11-continued

Plating Conditions and Organic-Inorganic Composite Film Treating Solution Conditions

| No. | Foundation plating | Hot-dip plating | Inorganic-organic composite film treating solution |
|---|---|---|---|
| D | electroplating of Ni in deposition q'ty of 0.8 g/m$^2$ | Sn plating bath containing Zn 15% and balance of Sn and unavoidable impurities, at 350° C. | without organic-inorganic composite treatment film |
| E | electroplating of Ni in deposition q'ty of 0.8 g/m$^2$ | Sn plating bath containing Zn 15% and balance of Sn and unavoidable impurities, at 450° C. | aqueous solution containing acrylic resin 5 g/l, chromic acid 20 g/l, silica 10 g/l and organic phosphoric acid 3 g/l |

TABLE 12

Alloy Layer, Plating Layer, Inorganic-Organic Composite Film Condition

| No. | Plating conditions | Alloy layer Fe + Sn (%) | Alloy layer Thickness (μm) | Zn | Mn | Cd | Al | Cr (%) | Ti | Mg | Sn | Thickness (μm) | Inorganic-organic composite film: Film composition | Inorganic-organic composite film: Deposition q'ty (g0/m$^2$) | Remarks |
|---|---|---|---|---|---|---|---|---|---|---|---|---|---|---|---|
| 1 | A | 100 | 0.4 | 8.0 | — | — | — | — | — | — | Balance | 5.8 | acrylic resin 13%, chromic acid 53%, silica 26%, organic phosphoric acid 8% | 0.08 | This Invention |
| 2 | A | 100 | 0.05 | 8.0 | — | — | — | — | — | — | " | 2.0 | acrylic resin 13%, chromic acid 53%, silica 26%, organic phosphoric acid 8% | 0.02 | |
| 3 | A | 100 | 1.5 | 8.0 | — | — | — | — | — | — | " | 15.0 | acrylic resin 13%, chromic acid 53%, silica 26%, organic phosphoric acid 8% | 0.50 | |
| 4 | A | 100 | 0.4 | 8.0 | — | — | — | — | — | — | " | 5.8 | acrylic resin 13%, chromic acid 53%, silica 26%, organic phosphoric acid 8% | 0.01 | |
| 5 | A | 100 | 0.4 | 8.0 | — | — | — | — | — | — | " | 5.8 | acrylic resin 13%, chromic acid 53%, silica 26%, organic phosphoric acid 8% | 2.0 | |
| 6 | A | 100 | 0.4 | 8.0 | 1.0 | 1.0 | — | 1.0 | 1.0 | — | " | 5.8 | acrylic resin 13%, chromic acid 53%, silica 26%, organic phosphoric acid 8% | 0.08 | |
| 7 | A | 100 | 0.4 | 8.0 | — | — | 1.0 | — | — | — | " | 5.8 | acrylic resin 13%, chromic acid 53%, silica 26%, organic phosphoric acid 8% | 0.08 | |
| 8 | B | 80 Ni:20 | 0.5 | 12.0 | — | — | — | — | — | 1.0 | " | 4.2 | acryl-modified epoxy resin 50%, barium chromate 25%, silica | 0.08 | |

TABLE 12-continued

Alloy Layer, Plating Layer, Inorganic-Organic Composite Film Condition

| No. | Plating conditions | Alloy layer Fe + Sn (%) | Alloy layer Thickness (μm) | Zn | Mn | Cd | Al | Cr | Ti | Mg | Sn | Thickness (μm) | Inorganic-organic composite film: Film composition | Deposition q'ty (g0/m²) | Remarks |
|---|---|---|---|---|---|---|---|---|---|---|---|---|---|---|---|
| 9 | C | 57 Ni:43 | 0.4 | 9.2 | — | — | 1.2 | — | — | — | " | 8.2 | 25% polyester resin 66%, silica 17%, potassium permanganate 17% | 0.15 | |
| 10 | D | 80 Ni:20 | 0.5 | 15.0 | — | — | — | — | — | — | " | 6.0 | no film formation | — | Comparative Materials |
| 11 | E | 80 Ni:20 | 2.3 | 15.0 | — | — | — | — | — | — | " | 7.0 | acrylic resin 13%, chromic acid 53%, silica 26%, organic phosphoric acid 8% | 0.08 | |
| 12 | A | 100 | 0.4 | 8.0 | — | — | — | — | — | — | " | 1.5 | acrylic resin 13%, chromic acid 53%, silica 26%, organic phosphoric acid 8% | 0.08 | |
| 13 | A | 100 | 0.4 | 8.0 | — | — | — | — | — | — | " | 5.8 | acrylic resin 13%, chromic acid 53%, silica 26%, organic phosphoric acid 8% | 0.005 | |
| 14 | A | 100 | 0.4 | 8.0 | — | — | — | — | — | — | " | 5.8 | acrylic resin 13%, chromic acid 53%, silica 26%, organic phosphoric acid 8% | 2.5 | |
| 15 | Conventional turn sheet used for gasoline tank material (Pb—Sn alloy plated steel sheet), deposition q'ty 40 g/m² | | | | | | | | | | | | | | |

Remarks: underlines represent those materials which are out of the range of this invention.

TABLE 13

Corrosion resistance, press formability and weldability

| No. | Evaluation: Eluted ions and q'ty (%) | Press formability | Seam weldability | Spot weldability | Remarks |
|---|---|---|---|---|---|
| 1 | mainly Zn 300 ppm | ◎ | ◎ | ◎ | This Invention |
| 2 | Zn 800 ppm | ◎ | ○ | ○ | |
| 3 | Zn 60 ppm | ○ | ◎ | ○ | |
| 4 | Zn 1000 ppm | ◎ | ○ | ○ | |
| 5 | Zn 40 ppm | ◎ | ○ | ○ | |
| 6 | Zn 250 ppm | ◎ | ◎ | ◎ | |
| 7 | Zn 240 ppm | ◎ | ◎ | ◎ | |
| 8 | Zn 270 ppm | ◎ | ◎ | ◎ | |
| 9 | Zn 200 ppm | ◎ | ◎ | ◎ | |
| 10 | Zn 4600 ppm | ○ | x | x | Comparative Materials |
| 11 | Zn 450 ppm | x | ○ | ○ | |
| 12 | Zn, Fe 4000 ppm | ○ | ○ | ○ | |
| 13 | Zn 2000 ppm | ◎ | x | x | |
| 14 | Zn 40 ppm | ◎ | x | x | |
| 15 | Pb: 9700 ppm<br>Fe: 1200 ppm | — | — | — | |

Bondability was evaluated by seam weldability and spot weldability.

Seam weldability:

Continuous seam welding was carried out by a constant current control system (disc diameter 300 mmϕ, electrode diameter 6 R) of a 60 Hz single-phase alternating current, and weldability was judged by inspecting the section and the surface of the weld portion.

Spot weldability

A continuous break point test was carried out by using a stationary spot welding machine and an electrode having a tip diameter of 6 mm by a constant current control system of a 60 Hz single-phase alternating current.

The section was inspected every 20 breaking points, and the number of breaking points before a nugget diameter fell below a predetermined value was calculated so as to judge weldability.

The symbols for evaluation are as follows.

◎: excellent

○: fair

×: inferior (Example 14)

Hereinafter, the Examples of the Zn—Sn plated steel sheets produced by the method of the present invention will be explained.

Each material obtained by hot rolling a slab, pickling, cold rolling and then annealing was used as a to-be-plated material. Part of these materials were pre-plated after annealing, and were used as the to-be-plated materials. Thereafter, a flux was applied to each material, and the material was passed through a Sn—Zn bath and after the plating quantity was adjusted, each sheet was taken up.

Table 14 tabulates various operation conditions, plating states after plating, and plating adhesion. Incidentally, cooling after plating was carried out at a rate of at least 20° C./sec.

Samples produced under the operation conditions of Nos. 1 to 15 shown in Table 14 were free from inferior plating and peeling of the plating and were excellent. On the other hand, samples produced under the operation conditions of Nos. 16 to 19 had the problems of inferior plating and adhesion of plating.

Inferior plating evaluation point/examination by naked eye:

⊙: no inferior plating

Δ: slight inferior plating

×: inferior plating

Plating adhesion evaluation point/cylindrical press (blank system 70 mm, drawing depth 15 mm), taping of outer side surface ⊙: no peeling of the plating Δ: slight peeling of the plating ×: peeling of the plating Plating quantity was expressed by nickel content.

Table 15 tabulates various operation conditions and the zinc crystals state in the plating layer.

When the zinc distribution state of the surface of the plating layer of each of the samples produced under the operation conditions of Nos. 1 to 15 shown in Table 15 was inspected, the number of the zinc crystals having a size greater than 250 $\mu$m, that affected adhesion of plating and the corrosion resistance, was not greater than 20 crystals/0.25 $mm^2$ and was extremely small. On the other hand, in the samples produced under the operation conditions of Nos. 16 to 19, the density of the zinc crystals having a great length was high.

TABLE 14

| Section | No. | Kind of pre-plating (wt %) | Pre-plating q'ty ($g/m^2$)*1 | Cl content in flux (wt %) | Bath temp. (°C.) | Zn content in bath (wt %) | Bath immersion time (sec) | Inferior plating state*2 | Adhesion of plating*3 |
|---|---|---|---|---|---|---|---|---|---|
| This Invention | 1 | Ni | 0.30 | 43.5 | 264 | 3 | 10.0 | ⊙ | ⊙ |
| | 2 | Ni | 2.20 | 10.5 | 505 | 3 | 1.5 | ⊙ | ⊙ |
| | 3 | Ni | 0.95 | 3.0 | 411 | 3 | 14.5 | ⊙ | ⊙ |
| | 4 | Ni | 0.55 | 43.5 | 235 | 10 | 2.0 | ⊙ | ⊙ |
| | 5 | Ni | 0.14 | 20.0 | 505 | 10 | 14.0 | ⊙ | ⊙ |
| | 6 | Ni | 0.25 | 3.0 | 298 | 20 | 9.5 | ⊙ | ⊙ |
| | 7 | Ni | 0.85 | 43.5 | 475 | 20 | 1.5 | ⊙ | ⊙ |
| | 8 | Ni | 2.95 | 43.5 | 298 | 20 | 14.0 | ⊙ | ⊙ |
| | 9 | Ni | 1.05 | 10.5 | 536 | 60 | 2.0 | ⊙ | ⊙ |
| | 10 | Ni | 2.95 | 43.5 | 475 | 60 | 2.0 | ⊙ | ⊙ |
| | 11 | 20Ni–80% Fe | 0.25 | 3.0 | 367 | 60 | 9.5 | ⊙ | ⊙ |
| | 12 | 20Ni–80% Fe | 1.05 | 10.5 | 571 | 20 | 10.0 | ⊙ | ⊙ |
| | 13 | 20Ni–80% Fe | 2.20 | 10.5 | 235 | 3 | 2.0 | ⊙ | ⊙ |
| | 14 | 80Ni–20% Fe | 0.15 | 3.0 | 367 | 61 | 9.5 | ⊙ | ⊙ |
| | 15 | 80Ni–20% Fe | 0.85 | 43.5 | 235 | 10 | 10.0 | ⊙ | ⊙ |
| Compartive Materials | 16 | Ni | 0.03 | 3.0 | 411 | 10 | 60.0 | x | x |
| | 17 | 20Ni–80% Fe | 1.05 | 1.5 | 475 | 80 | 180 | x | x |
| | 18 | 20Ni–80% Fe | 1.05 | 20.0 | 225 | 30 | 125 | x | x |
| | 19 | no preplating | — | 1.5 | 411 | 20 | 62.0 | x | x |

*1Plating q'ty was expressed by Ni content.
*2Plating evaluation (inspection by naked eye):
⊙: no inferior plating
Δ: slight inferior plating
x: inferior plating
*3Plating adhesion evaluation/taping to outside surface of cylinder press (blank diameter 70 mm, drawing depth 15 mm)
⊙: no peeling of the plating
Δ: slight peeling of the plating
x: peeling of the plating

TABLE 15

| Section | No. | Kind of pre-plating (wt %) | Pre-plating q'ty ($g/m^2$)*1 | Cooling rate (°C./sec) | Bath temp. (°C.) | Zn content in bath (wt %) | Zn distribution state in plating layer*2 |
|---|---|---|---|---|---|---|---|
| This Invention | 4 | Ni | 0.55 | 20.8 | 235 | 10 | ⊙ |
| | 5 | Ni | 0.15 | 20.5 | 505 | 10 | ⊙ |
| | 6 | Ni | 0.25 | 34.8 | 298 | 20 | ⊙ |
| | 7 | Ni | 0.85 | 35.2 | 475 | 20 | ⊙ |
| | 8 | Ni | 2.95 | 68.8 | 298 | 20 | ⊙ |
| | 9 | Ni | 1.05 | 48.9 | 536 | 60 | ⊙ |

TABLE 15-continued

| Section | No. | Kind of pre-plating (wt %) | Pre-plating q'ty ($g/m^2$)*1 | Cooling rate (°C./sec) | Bath temp. (°C.) | Zn content in bath (wt %) | Zn distribution state in plating layer*2 |
|---|---|---|---|---|---|---|---|
| | 10 | Ni | 2.95 | 36.1 | 475 | 60 | ⊙ |
| | 11 | 20Ni–80% Fe | 0.25 | 20.6 | 367 | 60 | ⊙ |
| | 12 | 20Ni–80% Fe | 1.05 | 50.4 | 571 | 20 | ⊙ |
| | 13 | 20Ni–80% Fe | 2.20 | 20.9 | 235 | 3 | ⊙ |
| | 14 | 80Ni–20% Fe | 0.15 | 20.1 | 367 | 61 | ⊙ |
| | 15 | 80Ni–20% Fe | 0.85 | 69.6 | 235 | 10 | ⊙ |
| Comparative | 16 | Ni | 0.03 | 3.8 | 411 | 10 | Δ |
| Materials | 17 | 20Ni–80% Fe | 1.05 | 16.9 | 475 | 60 | x |
| | 18 | 20Ni–80% Fe | 1.05 | 2.9 | 225 | 30 | x |
| | 19 | no preplating | — | 19.5 | 411 | 20 | Δ |

*1Plating q'ty was expressed by Ni content.
*2Evaluation of Zn distribution state in plating layer/area ratio of coarse Zn crystals by SEM inspection of plating layer surface
⊙: not more than 20 crystals/0.25 $mm^2$ of Zn crystals greater than 250 μm in length
Δ: 20 to 50 crystals/0.25 $mm^2$ of Zn crystals greater than 250 μm in length
x: more than 50 crystals/0.25 $mm^2$ of Zn crystals greater than 250 μm in length (Example 15)

Each material obtained by applying Ni pre-plating in a plating quantity of 0.5 $g/m^2$ to a low carbon steel, that was produced by hot rolling, pickling, cold rolling and annealing, was used as a to-be-plated material. Each of the resulting sheets was then passed through a hot-dip plating line having a non-oxidizing furnace-reducing furnace. Plating pre-treatment was carried out at a maximum sheet temperature in the non-oxidizing furnace of 500° C., an air ratio of 0.95, a maximum sheet temperature in the reducing furnace of 760° C., a ratio of retention time in the non-oxidizing furnace to retention time in the reducing furnace of 0.9, a dew point at the outlet of the reducing furnace of −45° C. and a hydrogen concentration at the outlet of the reducing furnace of 12 vol %. The sheet temperature at the entrance portion of the bath was adjusted to 300° C., and each sheet was passed through a plating bath containing 10 wt % of zinc and 90 wt % of tin at 295° C. for 5 seconds. The plating quantity was adjusted to 40 $g/m^2$ per surface at the rise point from the bath, and each sheet was cooled at a rate of 30 ° C./sec.

As a result, no inferior plating was found by the inspection by naked eye, and peeling by ball impact did not occur either. In other words, the steel sheets of the present invention were confirmed to have excellent basic performance. Macroscopic zinc crystals having a major diameter of greater than 250 μm did not occur in the plating layer, either, and the plating structure was found excellent.

(Example 16)

Low carbon steel sheets were produced by hot rolling a slab and conducting pickling, cold rolling and then annealing. Each cold rolled sheet, which was pre-plated or was not pre-plated, was used as a to-be-plated material. Thereafter, each sheet was passed through a hot-dip plating line having a non-oxidizing furnace-reducing furnace so as to produce a Zn—Sn plated steel sheet. Incidentally, the plating quantity was adjusted to 40 $g/m^2$ per surface, and the cooling rate was set to a rate of 25° C./second when the zinc content in the plating layer was at least 8.8 wt %, and to a rate of 10° C./sec when the zinc content was less than 8.8 wt %. Tables 16 and 17 tabulate the basic production conditions under various furnace operation conditions and Table 16 tabulates the inferior plating state after plating and adhesion of plating.

As shown in Tables 16 and 17, the steel sheets produced under the operation conditions of Nos. 1 to 16 were excellent without the occurrence of peeling of the plating in a forming test. On the other hand, the steel sheets produced under the conditions of Nos. 17 to 20 exhibited problems in basic performance such as inferior plating or adhesion of plating.

Table 17 shows the crystal state of zinc in the plating layer during production. When the zinc distribution state of the surface of the plating layer of each of the samples produced under the conditions of Nos. 1 to 16 was inspected, the number of the zinc crystals having a major diameter of at least 250 μm, that affected adhesion of plating and the corrosion resistance, was not greater than 20 crystals/0.25 $mm^2$ and was extremely small, and adhesion of the plating was excellent, too. The samples produced under the conditions of Nos. 17 to 20 had a high density of the zinc crystals having a large length, and the problem of the adhesion of the plating occurred.

TABLE 16

| Section | No. | Kind of pre-plating (wt %) | Pre-plating q'ty ($g/m^2$)*2 | NOF max sheet temp. (°C.)*3 | NOF air ratio*3 | RTF max sheet temp. (°C.)*3 | NOF/RTF time ratio | RTF outlet dew point (°C.) | Zn content in bath (wt %) | Bath temp. (°C.)*4 | Bath pass time (sec) | Inferior plating state*5 | Plating adhesion*6 |
|---|---|---|---|---|---|---|---|---|---|---|---|---|---|
| This | 1 | Ni | 0.25 | 355 | 0.90 | 600 | 1 | −23 | 2.0 | 250 | 5.8 | ⊙ | ⊙ |
| Invention | 2 | Ni | 2.95 | 645 | 1.30 | 755 | 1 | −25 | 2.0 | 250 | 1.6 | ⊙ | ⊙ |
| | 3 | Ni | 0.25 | 500 | 1.00 | 700 | 0.5 | −30 | 10.0 | 250 | 3.5 | ⊙ | ⊙ |

TABLE 16-continued

| | | | | | | | | | | | | | |
|---|---|---|---|---|---|---|---|---|---|---|---|---|---|
| | 4 | Ni | 2.90 | 360 | 0.90 | 600 | 0.5 | −31 | 10.0 | 505 | 1.6 | ◎ | ◎ |
| | 5 | Ni | 2.95 | 540 | 1.00 | 695 | 0.35 | −32 | 30.0 | 610 | 3.5 | ◎ | ◎ |
| | 6 | Ni | 0.30 | 365 | 0.90 | 605 | 0.5 | −32 | 60.0 | 390 | 1.6 | ◎ | ◎ |
| | 7 | 20% Ni | 0.50 | 355 | 1.00 | 605 | 1.0 | −31 | 2.0 | 250 | 5.8 | ◎ | ◎ |
| | 8 | 20% Ni | 2.95 | 645 | 0.90 | 770 | 1.0 | −31 | 2.0 | 505 | 1.6 | ◎ | ◎ |
| | 9 | 20% Ni | 0.55 | 540 | 1.30 | 730 | 0.5 | −32 | 10.0 | 250 | 1.6 | ◎ | ◎ |
| | 10 | 20% Ni | 2.90 | 355 | 1.00 | 625 | 0.5 | −32 | 60.0 | 390 | 5.8 | ◎ | ◎ |
| | 11 | 80% Ni | 0.30 | 355 | 1.00 | 605 | 1.0 | −32 | 2.0 | 250 | 3.5 | ◎ | ◎ |
| | 12 | 80% Ni | 2.85 | 640 | 1.00 | 755 | 1.0 | −33 | 2.0 | 505 | 1.6 | ◎ | ◎ |
| | 13 | 80% Ni | 1.95 | 650 | 0.90 | 760 | 0.35 | −32 | 30.0 | 610 | 3.5 | ◎ | ◎ |
| | 14 | nil | — | 520 | 0.90 | 725 | 1.0 | −28 | 2.0 | 250 | 1.6 | ◎ | ◎ |
| | 15 | nil | — | 565 | 0.90 | 730 | 0.35 | −33 | 10.0 | 250 | 5.8 | ◎ | ◎ |
| | 16 | nil | — | 735 | 1.00 | 805 | 0.35 | −36 | 10.0 | 505 | 1.6 | ◎ | ◎ |
| Compar- | 17 | Ni | 0.1 | 365 | 0.80 | 625 | 1.5 | −31 | 85.0 | 405 | 10.5 | x | x |
| ative | 18 | 20% Ni | 0.5 | 540 | 1.50 | 735 | 0.5 | −30 | 85.0 | 405 | 3.5 | x | x |
| Materials | 19 | 80% Ni | 3.3 | 625 | 0.90 | 755 | 1.5 | −15 | 2.0 | 600 | 10.5 | x | x |
| | 20 | nil | — | 805 | 1.30 | 855 | 1.5 | −22 | 2.0 | 250 | 3.5 | x | x |

*1: Nickel-iron plating was expressed by Ni content (wt %).
*2: Pre-plating q'ty was expressed by Ni content ($g/m^2$)
*3: NOF: non-oxidizing furnace, RTF: reducing furnace
*4: Melting point of Sn—Zn bath with respect to Zn addition amount, and has the relation tabulated below.

| Zn content in plating bath wt % | 2 | 10 | 30 | 60 | 85 |
|---|---|---|---|---|---|
| m.p./°C. | 220 | 215 | 315 | 360 | 390 |

*5: Evaluation of plating/inspection by naked eye
◎: no inferior plating
Δ: slight inferior plating
x: inferior plating
*6: Evaluation of plating adhesion/confirmation of peeling of the plating by taping to outside of cylinder press (blank diameter 70 mm, drawing depth 15 mm)
◎: no peeling of the plating
Δ: slight peeling of the plating
x: peeling of the plating

TABLE 17

| Section | No. | Kind of pre-plating (wt %)*1 | Pre-plating q'ty ($g/m^2$)*2 | Zn content in bath (wt %) | Bath temp. (°C.) | Cooling rate °C./sec | Zn distribution in plating layer and adhesion*3 |
|---|---|---|---|---|---|---|---|
| This | 2 | Ni | 2.95 | 2.0 | 515 | 20.1 | ◎ |
| Invention | 3 | Ni | 0.25 | 10.0 | 250 | 20.9 | ◎ |
| | 4 | Ni | 2.90 | 10.0 | 515 | 49.7 | ◎ |
| | 5 | Ni | 2.95 | 30.0 | 620 | 52.1 | ◎ |
| | 6 | Ni | 0.30 | 60.0 | 390 | 21.1 | ◎ |
| | 8 | 20% Ni | 2.95 | 2.0 | 515 | 19.8 | ◎ |
| | 9 | 20% Ni | 0.55 | 10.0 | 250 | 20.5 | ◎ |
| | 10 | 20% Ni | 2.90 | 60.0 | 390 | 21.1 | ◎ |
| | 12 | 80% Ni | 2.85 | 2.0 | 515 | 20.2 | ◎ |
| | 13 | 80% Ni | 1.95 | 30.0 | 620 | 51.1 | ◎ |
| | 15 | nil | — | 10.0 | 250 | 21.2 | ◎ |
| | 16 | nil | — | 10.0 | 515 | 29.8 | ◎ |
| Comparative | 17 | Ni | 0.1 | 85.0 | 390 | 10.5 | Δ |
| Materials | 18 | 20% Ni | 0.5 | 85.0 | 390 | 15.1 | Δ |
| | 19 | 80% Ni | 3.5 | 35.0 | 600 | 17.0 | Δ |
| | 20 | nil | — | 15.0 | 250 | 5.8 | Δ |

*1Ni—Fe pre-plating was expressed by nickel content (wt %).
*2Pre-plating quantity was expressed by nickel content ($g/m^2$).
*3Evaluation of Zn distribution state in plating layer/area ratio of coarse Zn crystals by SEM surface inspection of plating layer, and evaluation of adhesion:
◎: not more than 20 crystals/0.25 $mm^2$ of Zn crystals greater than 250 μm in length
Δ: 20 to 50 crystals/0.25 $mm^2$ of Zn crystals greater than 250 μm in length
x: more than 50 crystals/0.25 $mm^2$ of Zn crystals greater than 250 μm in length

INDUSTRIAL APPLICABILITY

As described above, the present invention provides extremely excellent effects in that rust-proofing steel sheets for fuel tanks having various excellent characteristics as a fuel tank material can be obtained.

We claim:

1. A rust-proofing steel sheet for a fuel tank characterized in that an alloy layer containing at least one of nickel, iron, zinc and tin is deposited onto each surface of a steel sheet to a thickness of not greater than 2 μm per surface, and a Sn—Zn alloy plating layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm per surface.

2. A rust-proofing steel sheet for a fuel tank according to claim 1, wherein surface coarseness Ra of said Sn—Zn alloy plating layer is 0.2 to 3.0 μm.

3. A rust-proofing steel sheet for a fuel tank characterized in that an alloy layer containing at least one of nickel, iron, zinc and tin is deposited onto each surface of a steel sheet consisting of $C \leqq 0.1\%$, $Si \leqq 0.1\%$, $0.05 \leqq Mn \leqq 1.2\%$, $P \leqq 0.04\%$, $Al \leqq 0.1\%$ and the balance of iron and unavoidable impurities to a thickness of not greater than 1.5 μm per surface, and a Sn—Zn alloy layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm.

4. A rust-proofing steel sheet for a fuel tank according to claim 3, wherein at least one of 0.0002 to 0.0030 wt % of B, not greater than 1.0 wt % of Ti and/or Nb and 0.2 to 6.0 wt % of Cr is added besides the component composition of said steel sheet to which said Sn—Zn alloy plating layer is applied.

5. A rust-proofing steel sheet for a fuel tank characterized in that an alloy layer containing at least one of nickel, iron, zinc and tin is deposited onto each surfaces of a steel sheet consisting of $C \leqq 0.1\%$, $Si \leqq 0.1\%$, $0.05 \leqq Mn \leqq 1.2\%$, $P \leqq 0.04\%$, $Al \leqq 0.1\%$, 0.0002 to 0.0030% of B, Ti and/or $Nb \leqq 1.0\%$ and the balance of iron and unavoidable impurities to a thickness of not greater than 1.5 μm per surface, and a Sn—Zn alloy plating layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm.

6. A rust-proofing steel sheet for a fuel tank characterized in that an alloy layer containing at least one of nickel, iron, zinc and tin is deposited onto each surface of a steel sheet to a thickness of not greater than 2 μm, a Sn—Zn alloy plating layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm per surface, and the size of the major diameter of the plating metal crystals is not greater than 20 mm on the outermost surface of each alloy plating layer.

7. A rust-proofing steel sheet for a fuel tank according to claim 1, wherein a chromate film is further deposited onto the outside of each alloy plating layer to a coating weight of 0.2 to 100 mg chromium/$m^2$ on each surface.

8. A rust-proofing steel sheet for a fuel tank according to claim 1, wherein 0.01 to 2.0 g/$m^2$ of an organic-inorganic composite film comprising a resin matrix having at least one of Cr, Si, P and Mn dispersed therein is further deposited on the outside of each alloy plating layer.

9. A rust-proofing steel sheet for a fuel tank according to claim 8, wherein said organic-inorganic composite film contains not greater than 20% in total of chromium, silicon, phosphorus and manganese compounds.

10. A rust-proofing steel sheet for a fuel tank according to claim 8, wherein said organic-inorganic composite film is of an acrylic, a polyester and/or an epoxy.

11. A production method for rust-proofing steel sheet for a fuel tank, comprising the steps of:

applying Ni—Fe pre-plating onto an annealed steel sheet in a plating quantity of 0.1 to 3.0 g/$m^2$ in terms of a nickel content;

applying a flux containing hydrochloric acid in a quantity of 2 to 45 wt % calculated as a chlorine content;

immersing said steel sheet in a bath consisting of 40 to 99 wt % of tin and the balance of zinc for less than 15 seconds at a bath temperature of (bath composition melting point +20° C.) to (bath composition melting point+300° C.) for plating; and cooling said plated steel sheet at a cooling rate of at least 10° C./sec.

12. A production method for rust-proofing steel sheet for a fuel tank, comprising the steps of:

applying nickel or Ni—Fe pre-plating onto an annealed steel sheet in a plating quantity of 0.1 to 3.0 g/$m^2$ in terms of a nickel content;

conducting plating pre-treatment first inside a non-oxidizing furnace with a maximum sheet temperature of 350° C. to 650° C. and with the ratio of quantity of air used to stoichiometric combustion air being 0.85 to 1.30 and then inside a reducing furnace with a maximum sheet temperature of 600° C. to 770°C.;

adjusting the sheet temperature immediately before plating to the plating bath temperature;

immersing said steel sheet in a bath consisting of 40 to 99 wt % of tin and the balance of zinc and unavoidable impurities for less than 6 seconds at a bath temperature of (bath composition melting point+20° C.) to (bath composition melting point+3000C.) for plating; and cooling said plated steel sheet at a cooling rate of at least 10° C./sec.

13. A production method for rust-proofing steel sheet for a fuel tank comprising the steps of:

conducting plating pre-treatment for a cold rolled steel sheet first inside a non-oxidizing furnace with a maximum sheet temperature of 450° C. to 750° C. and with the ratio of quantity of air used to stoichiometric combustion air being 0.85 to 1.30 and then inside a reducing furnace with a maximum sheet temperature of 680° C. to 850° C., the ratio of a retention time inside said non-oxidizing furnace to a retention time inside said reducing furnace being 1 to ⅓ and an outlet dew point of said reducing furnace being not higher than −25°C.;

adjusting the sheet temperature immediately before plating to the plating bath temperature;

immersing said steel sheet in a bath consisting of 40 to 99 wt % of tin and the balance of zinc and unavoidable impurities for less than 6 seconds at a bath temperature of (bath composition melting point+20° C. to (bath composition melting point+300°C.) for plating; and cooling said plated steel sheet at a cooling rate of at least 10° C./sec.

14. A rust-proofing steel sheet for a fuel tank according to claim 3, wherein a chromate film is further deposited onto the outside of each alloy plating layer to a coating weight of 0.2 to 100 mg chromium/$m^2$ on each surface.

15. A rust-proofing steel sheet for a fuel tank according to claim 3, wherein 0.01 to 2.0 g/$m^2$ of an organic-inorganic composite film comprising a resin matrix having at least one of Cr, Si, P and Mn dispersed therein is further deposited on the outside of each alloy plating layer.

16. A rust-proofing steel sheet for a fuel tank according to claim 5, wherein a chromate film is further deposited onto the outside of each alloy plating layer to a coating weight of 0.2 to 100 mg chromium/$m^2$ on each surface.

17. A rust-proofing steel sheet for a fuel tank according to claim 5, wherein 0.01 to 2.0 g/$m^2$ of an organic-inorganic composite film comprising a resin matrix having at least one of Cr, Si, P and Mn dispersed therein is further deposited on the outside of each alloy plating layer.

18. A rust-proofing steel sheet for a fuel tank according to claim 6, wherein a chromate film is further deposited onto the outside of each alloy plating layer to a coating weight of 0.2 to 100 mg chromium/$m^2$ on each surface.

19. A rust-proofing steel sheet for a fuel tank according to claim 6, wherein 0.01 to 2.0 g/$m^2$ of an organic-inorganic composite film comprising a resin matrix having at least one of Cr, Si, P and Mn dispersed therein is further deposited on the outside of each alloy plating layer.

* * * * *

US005827618C1

(12) REEXAMINATION CERTIFICATE (4826th)

United States Patent

Oyagi et al.

(10) Number: US 5,827,618 C1

(45) Certificate Issued: Aug. 5, 2003

(54) RUST-PROOFING STEEL SHEET FOR FUEL TANKS AND PRODUCTION METHOD THEREOF

(75) Inventors: Yashichi Oyagi, Kitakyushu (JP); Takayuki Omori, Kitakyushu (JP); Masahiro Fuda, Kitakyushu (JP); Ken Sawada, Kitakyushu (JP); Nobuyoshi Okadu, Kitakyushu (JP)

(73) Assignee: Nippon Steel Corporation, Tokyo (JP)

Reexamination Request:
No. 90/005,958, Mar. 22, 2001

Reexamination Certificate for:

| | |
|---|---|
| Patent No.: | **5,827,618** |
| Issued: | **Oct. 27, 1998** |
| Appl. No.: | **08/750,073** |
| Filed: | **Nov. 27, 1996** |

(22) PCT Filed: Mar. 28, 1996

(86) PCT No.: PCT/JP96/00835

§ 371 (c)(1),
(2), (4) Date: Nov. 27, 1996

(87) PCT Pub. No.: WO96/30560

PCT Pub. Date: Oct. 3, 1996

(30) Foreign Application Priority Data

| | | |
|---|---|---|
| Mar. 28, 1995 | (JP) | 7-069087 |
| Mar. 29, 1995 | (JP) | 7-070259 |
| Mar. 29, 1995 | (JP) | 7-070260 |
| Mar. 30, 1995 | (JP) | 7-073140 |
| May 31, 1995 | (JP) | 7-132995 |
| Jun. 20, 1995 | (JP) | 7-152846 |
| Sep. 1, 1995 | (JP) | 7-224906 |
| Sep. 6, 1995 | (JP) | 7-228709 |

(51) Int. Cl.[7] ..... B21D 39/00; B32B 15/01; B05D 1/36; C21D 1/09

(52) U.S. Cl. ..... 428/621; 428/624; 428/646; 428/648; 428/658; 428/659; 428/680; 428/681; 428/682; 428/684; 428/458; 427/398.1; 427/405; 427/433; 148/530

(58) Field of Search ..... 428/646, 648, 428/658, 659, 680, 681, 682, 684, 621, 624, 458; 427/398.1, 405, 433; 148/530

(56) References Cited

U.S. PATENT DOCUMENTS

| | | | | |
|---|---|---|---|---|
| 4,339,284 A | | 7/1982 | Hashimoto et al. | 148/12 |
| 4,461,679 A | | 7/1984 | Higuchi et al. | 204/27 |
| 4,576,657 A | | 3/1986 | Satoh et al. | 148/12 |
| 5,049,202 A | * | 9/1991 | Willis et al. | 148/13 |
| 5,429,882 A | | 7/1995 | Carey, II et al. | 428/647 |
| 5,489,490 A | | 2/1996 | Carey, II et al. | 428/647 |
| 5,491,035 A | | 2/1996 | Carey, II et al. | 428/647 |
| 5,491,036 A | | 2/1996 | Carey, II et al. | 428/647 |
| 5,496,652 A | | 3/1996 | Sasaki et al. | 428/623 |
| 5,597,656 A | | 1/1997 | Carey, II et al. | 428/647 |
| 5,827,618 A | | 10/1998 | Oyagi et al. | 428/621 |

FOREIGN PATENT DOCUMENTS

| | | |
|---|---|---|
| JP | 61-270391 | 11/1986 |
| JP | 63-66916 | 12/1988 |

* cited by examiner

*Primary Examiner*—Monique Jackson

(57) ABSTRACT

This invention provides a rust-proofed steel sheet for a fuel tank including an alloy layer containing at least one of Ni, Fe, Zn and Sn and deposited on the surface of a steel sheet to a thickness of 2 $\mu$m per surface, and a Sn—Zn alloy plating layer consisting of 40 to 99 wt % of Sn and the balance of iron, containing not greater than 20 crystals/0.25 $mm^2$ of zinc crystals having a major diameter of not greater than 250 $\mu$m and deposited on the alloy layer to a thickness of 2 to 50 $\mu$m per surface. The to-be-plated steel sheet to which the plating layer is applied has a composition consisting of C≦0.1%, Si≦0.1%, Mn: 0.05 to 1.2%, P≦0.040%, Al<0.1% and if necessary, at least one of B, Ti, Nb and Cr, and the balance of Fe and unavoidable impurities. This invention provides also a production method of a rust-proofing steel sheet for a fuel tank comprising the steps of applying Ni—Fe type pre-plating to an annealed steel sheet in a quantity of 0.1 to 3.0 $m/m^2$ per surface in terms of a Ni content, applying flux containing hydrochloric acid in a quantity of 2 to 45 wt % in terms of chlorine, immersing the steel sheet in a bath consisting of 40 to 99 wt % of Sn and the balance of Zn for less than 15 seconds at a bath temperature of (melting point+20° C.) to (melting point+300° C.) of a plating bath metal, for plating.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1 and 3–19 are determined to be patentable as amended.

1. A *fuel tank comprising a* rust-proofing steel sheet [for a fuel tank] characterized in that an alloy layer containing at least one of nickel, iron, zinc and tin is deposited onto each surface of a steel sheet to a thickness of not greater than 2 μm per surface, and a Sn—Zn alloy plating layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm per surface, *wherein surface coarseness Ra of said Sn—Zn alloy plating layer is 0.2 to 3.0 μm.*

3. A *fuel tank comprising a* rust-proofing steel sheet [for a fuel tank] characterized in that an alloy layer containing at least one of nickel, iron, zinc and tin is deposited onto each surface of a steel sheet consisting of C≦0.1%, Si≦0.1%, 0.05≦Mn≦1.2%, P≦0.04%, Al≦0.1% and the balance of iron and unavoidable impurities to a thickness of not greater than 1.5 μm per surface, and a Sn—Zn alloy *plating* layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm, *wherein surface coarseness Ra of said Sn—Zn alloy plating layer is 0.2 to 3.0 μm.*

4. A *fuel tank comprising a* rust-proofing steel sheet [for a fuel tank] according to claim 3, wherein at least one of 0.0002 to 0.0030 wt % of B, not greater than 1.0 wt % of Ti and/or Nb and 0.2 to 6.0 wt % of Cr is added besides the component composition of said steel sheet to which said Sn—Zn alloy plating layer is applied.

5. A *fuel tank comprising a* rust-proofing steel sheet [for a fuel tank] characterized in that an alloy layer containing at least one of nickel, iron, zinc and tin is deposited onto each surfaces of a steel sheet consisting of C≦0.1%, Si≦0.1%, 0.05≦Mn≦1.2%, P≦0.04%, Al≦0.1%, 0.0002 to 0.0030% of B, Ti and/or Nb≦1.0% and the balance of iron and unavoidable impurities to a thickness of not greater than 1.5 μm per surface, and a Sn—Zn alloy plating layer consisting of 40 to 99 wt % of tin and the balance of zinc and containing not greater than 20 crystals/0.25 $mm^2$ of zinc crystals having a major diameter of at least 250 μm is deposited onto each alloy layer to thickness of 2 to 50 μm, *wherein surface coarseness Ra of said Sn—Zn alloy plating layer is 0.2 to 3.0 μm.*

6. A *fuel tank comprising a* rust-proofing steel sheet [for a fuel tank] characterized in that an alloy layer containing at least one of nickel, iron, zinc and tin is deposited onto each surface of a steel sheet to a thickness of not greater than 2 μm, a Sn—Zn alloy plating layer consisting of 40 to 99 wt % of tin and the balance of zinc and containing not greater than 20 crystals/0.25 $mm^2$ of zinc crystals having a major diameter of at least 250 μm is deposited onto each alloy layer to a thickness of 2 to 50 μm per surface, and the size of the major diameter of the plating metal crystals is not greater than 20 mm on the outermost surface of each alloy plating layer, *wherein surface coarseness Ra of said Sn—Zn alloy plating layer is 0.2 to 3.0 μm.*

7. A *fuel tank comprising a* rust-proofing steel sheet [for a fuel tank] according to claim 1, wherein a chromate film is further deposited onto the outside of each alloy plating layer to a coating weight of 0.2 to 100 mg chromium/$m^2$ on each surface.

8. A *fuel tank comprising a* rust-proofing steel sheet [for a fuel tank] according to claim 1, wherein 0.01 to 2.0 g/$m^2$ of an organic-inorganic composite film comprising a resin matrix having at least one of Cr, Si, P and Mn dispersed therein is further deposited on the outside of each alloy plating layer.

9. A *fuel tank comprising a* rust-proofing steel sheet [for a fuel tank] according to claim 8, wherein said organic-inorganic composite film contains not greater than 20% in total of chromium, silicon, phosphorus and manganese compounds.

10. A *fuel tank comprising a* rust-proofing steel sheet [for a fuel tank] according to claim 8, wherein said organic-inorganic composite film is of an acrylic, a polyester and/or an epoxy.

11. A production method for *producing a fuel tank comprising a* rust-proofing steel sheet [for a fuel tank], *said method* comprising the steps of:

*providing an annealed steel sheet consisting essentially of C≦0.1%, Si≦0.1%, 0.05≦Mn≦1.2%, P≦0.04%, Al≦0.1% and the balance of iron and unavoidable impurities;* applying Ni—Fe pre-plating onto [an] *said* annealed steel sheet in a plating quantity of 0.1 to 3.0 g/$m^2$ in terms of a nickel content;

applying a flux containing hydrochloric acid in a quantity of 2 to 45 wt % calculated as a chlorine content;

immersing said steel sheet in a bath consisting of 40 to 99 wt % of tin and the balance of zinc for less than 15 seconds at a bath temperature of (bath composition melting point +20° C.) to (bath composition melting point+300° C.) for plating; and *thereby providing a Sn—Zn alloy plating layer having a thickness of 2 to 50 μm on said Ni—Fe pre-plating;* cooling said plated steel sheet at a cooling rate of at least 10° C./sec., *and thereby providing said Sn—Zn alloy plating layer containing not greater than 20 crystals/0.25 $mm^2$ of zinc crystals having a major diameter of at least 250 μm; and*

*fabricating said steel sheet having said Sn—Zn alloy plating layer into said fuel tank.*

12. A production method for *producing a fuel tank comprising a* rust-proofing steel sheet [for a fuel tank], *said method* comprising the steps of:

*providing an annealed steel sheet consisting essentially of C≦0.1%, Si≦0.1%, 0.05≦Mn≦1.2%, P≦0.04%, Al≦0.1% and the balance of iron and unavoidable impurities;* applying nickel or Ni—Fe pre-plating onto [an] *said* annealed steel sheet in a plating quantity of 0.1 to 3.0 g/m$^2$ in terms of a nickel content;

conducting plating pre-treatment first inside a nonoxidizing furnace with a maximum sheet temperature of 350° C. to 650° C. and with the ratio of quantity of air used to stoichiometric combustion air being 0.85 to 1.30 and then inside a reducing furnace with a maximum sheet temperature of 600° C. to 770° C.;

adjusting the sheet temperature immediately before plating to the plating bath temperature;

immersing said steel sheet in a bath consisting of 40 to 99 wt % of tin and the balance of zinc and unavoidable impurities for less than 6 seconds at a bath temperature of (bath composition melting point +20° C.) to (bath composition melting point+[3000]*300*° C.) for plating; and *thereby providing a Sn—Zn alloy plating layer having a thickness of 2 to 50 μm on said nickel or Fe—Ni pre-plating;* cooling said plated steel sheet at a cooling rate of at least 10° C./sec., *and thereby providing said Sn—Zn alloy plating layer containing not greater than 20 crystals/0.25 mm$^2$ of zinc crystals having a major diameter of at least 250 μm; and*

*fabricating said steel sheet having said Sn—Zn alloy plating layer into said fuel tank.*

13. A production method for *producing a fuel tank comprising a* rust-proofing steel sheet [for a fuel tank], *said method* comprising the steps of:

*providing a cold rolled steel sheet consisting essentially of $C \leqq 0.1\%$, $Si \leqq 0.1\%$, $0.05 \leqq Mn \leqq 1.2\%$, $P \leqq 0.04\%$, $Al \leqq 0.1\%$ and the balance of iron and unavoidable impurities;* conducting plating pre-treatment for [a] *said* cold rolled steel sheet first inside a non-oxidizing furnace with a maximum sheet temperature of 450° C. to 750° C. and with the ratio of quantity of air used to stoichiometric combustion air being 0.85 to 1.30 and then inside a reducing furnace with a maximum sheet temperature of 680° C. to 850° C., the ratio of a retention time inside said non-oxidizing furnace to a retention time inside said reducing furnace being 1 to ⅓ and an outlet dew point of said reducing furnace being not higher than −25° C.;

adjusting the sheet temperature immediately before plating to the plating bath temperature;

immersing said steel sheet in a bath consisting of 40 to 99 wt % of tin and the balance of zinc and unavoidable impurities for less than 6 seconds at a bath temperature of (bath composition melting point+20° C.*)* to (bath composition melting point+300° C.) for plating; and *thereby providing a Sn—Zn alloy plating layer having a thickness of 2 to 50 μm on said cold rolled steel sheet;* cooling said plated steel sheet at a cooling rate of at least 10° C./sec., *and thereby providing said Sn—Zn alloy plating layer containing not greater than 20 crystals/0.25 mm$^2$ of zinc crystals having a major diameter of at least 250 μm; and*

*fabricating said steel sheet having said Sn—Zn alloy plating layer into said fuel tank.*

14. A *fuel tank comprising a* rust-proofing steel sheet [for a fuel tank] according to claim 3, wherein a chromate film is further deposited onto the outside of each alloy plating layer to a coating weight of 0.2 to 100 mg chromium/m$^2$ on each surface.

15. A *fuel tank comprising a* rust-proofing steel sheet [for a fuel tank] according to claim 3, wherein 0.01 to 2.0 g/m$^2$ of an organic-inorganic composite film comprising a resin matrix having at least one of Cr, Si, P and Mn dispersed therein is further deposited on the outside of each alloy plating layer.

16. A *fuel tank comprising a* rust-proofing steel sheet [for a fuel tank] according to claim 5, wherein a chromate film is further deposited onto the outside of each alloy plating layer to a coating weight of 0.2 to 100 mg chromium/m$^2$ on each surface.

17. A *fuel tank comprising a* rust-proofing steel sheet [for a fuel tank] according to claim 5, wherein 0.01 to 2.0 g/m$^2$ of an organic-inorganic composite film comprising a resin matrix having at least one of Cr, Si, P and Mn dispersed therein is further deposited on the outside of each alloy plating layer.

18. A *fuel tank comprising a* rust-proofing steel sheet [for a fuel tank] according to claim 6, wherein a chromate film is further deposited onto the outside of each alloy plating layer to a coating weight of 0.2 to 100 mg chromium/m$^2$ on each surface.

19. A *fuel tank comprising a* rust-proofing steel sheet [for a fuel tank] according to claim 6, wherein 0.01 to 2.0 g/m$^2$ of an organic-inorganic composite film comprising a resin matrix having at least one of Cr, Si, P and Mn dispersed therein is further deposited on the outside of each alloy plating layer.

* * * * *